US007726773B2

(12) United States Patent
Nakamura et al.

(10) Patent No.: US 7,726,773 B2
(45) Date of Patent: Jun. 1, 2010

(54) WASTE LIQUID RECOVERY APPARATUS, RELAY AND LIQUID JETTING APPARATUS

(75) Inventors: Hiroto Nakamura, Matsumoto (JP); Takahiro Naka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 214 days.

(21) Appl. No.: 11/722,430

(22) PCT Filed: Dec. 20, 2005

(86) PCT No.: PCT/JP2005/023330

§ 371 (c)(1),
(2), (4) Date: Dec. 26, 2007

(87) PCT Pub. No.: WO2006/068119

PCT Pub. Date: Jun. 29, 2006

(65) Prior Publication Data

US 2008/0136864 A1 Jun. 12, 2008

(30) Foreign Application Priority Data

Dec. 22, 2004 (JP) ..... 2004-372054
Dec. 22, 2004 (JP) ..... 2004-372055
Dec. 22, 2004 (JP) ..... 2004-372056

(51) Int. Cl.
*B41J 2/165* (2006.01)

(52) U.S. Cl. ..... 347/36; 347/30; 347/35

(58) Field of Classification Search ..... 347/36, 347/29, 30, 23, 35
See application file for complete search history.

(56) References Cited

U.S. PATENT DOCUMENTS 4,556,894 A 12/1985 Terasawa
5,963,237 A 10/1999 Ikkatai et al.
6,022,102 A 2/2000 Ikkatai et al.
6,886,607 B2 5/2005 Takano
6,976,746 B2 12/2005 Shimamura
2003/0176005 A1 9/2003 Takano et al.

FOREIGN PATENT DOCUMENTS

CN 2355886 Y 12/1999
EP 0 803 362 A2 10/1997
EP 1 070 592 A1 1/2001
GB 328 729 5/1930
JP 404201353 A * 7/1992

(Continued)

OTHER PUBLICATIONS

Extended European Search Report from European patent appln. No. 05820334.0 (Jan. 25, 2008).

(Continued)

*Primary Examiner*—Shih-wen Hsieh
(74) *Attorney, Agent, or Firm*—Stroock & Stroock & Lavan LLP

(57) ABSTRACT

A waste liquid tank is arranged outside a printer. A connection port arranged at an upstream end of a duct extending from the waste liquid tank is connected to a transfer device. The transfer device is connected to a discharge side of a suction pump for drawing in ink from a nozzle of a recording head of the printer through a duct.

37 Claims, 13 Drawing Sheets

FOREIGN PATENT DOCUMENTS

| | | | |
|---|---|---|---|
| JP | 05-008400 | A | 1/1993 |
| JP | 07-001747 | A | 1/1995 |
| JP | 10-024613 | A | 1/1998 |
| JP | 10-029318 | A | 2/1998 |
| JP | 2000-168104 | A | 6/2000 |
| JP | 2001-063094 | | 3/2001 |
| JP | 2001-136749 | | 5/2001 |
| JP | 2001-219576 | A | 8/2001 |
| JP | 2001-225478 | | 8/2001 |
| JP | 2002-019149 | | 1/2002 |
| JP | 2003-136749 | | 5/2003 |
| JP | 2003-326732 | A | 11/2003 |
| JP | 2004-130569 | | 4/2004 |
| JP | 2004-130571 | | 4/2004 |
| JP | 2004-188758 | A | 7/2004 |
| JP | 2004-195799 | A | 7/2004 |
| JP | 2004-267832 | | 9/2004 |
| JP | 2004-276270 | A | 10/2004 |
| JP | 2004-330484 | A | 11/2004 |
| WO | 01/87624 | A1 | 11/2001 |

OTHER PUBLICATIONS

English translation of International Preliminary Report on Patentability for Int'l. Appln. No. PCT/JP2005/023330 (Jul. 5, 2007) [International Search Report filed on Jun. 21, 2007].

* cited by examiner

WASTE LIQUID RECOVERY APPARATUS, RELAY AND LIQUID JETTING APPARATUS

CROSS-REFERENCE TO RELATED APPLICATIONS

This application is based upon and claims the benefit of priority from prior Japanese Patent Application Nos. 2004-372054, 2004-372055, and 2004-372056, each filed on Dec. 22, 2004, the entire contents of which are incorporated herein by references.

TECHNICAL FIELD

The present invention relates to a waste liquid collection apparatus included in liquid ejection apparatus or the like having an ejection head for ejecting liquid and used to collect liquid drawn in from nozzles of the ejection head as a waste liquid, and to liquid ejection apparatus including the waste liquid collection apparatus. The present invention also relates to a transfer device included in a liquid ejection apparatus for connecting an ejection head and a waste liquid tank storing liquid drawn in from nozzles of the ejection head as waste liquid, and to a liquid ejection apparatus including the transfer device. The present invention further relates to a transfer device for connecting an ejection head and a tank storing liquid supplied to the ejection head, and to a liquid ejection apparatus including the transfer device.

RELATED ART

An inkjet printer is known as liquid ejection apparatus having liquid ejection mechanism for ejecting liquid in dots from nozzles of an ejection head. The inkjet printer may be either a printer having an on-carriage ink supply system in which an ink cartridge is mounted on a carriage or a printer having an off-carriage ink supply system in which an ink cartridge is mounted at a position separated from a carriage such as on a main body of the printer. A printer of the off-carriage ink supply system may use a large-capacity ink cartridge to print large-volume data or to perform printing on large-sized paper. Further, without having to mount an ink cartridge on its carriage, the printer of the off-carriage ink supply system can downsize the carriage and prevent the size of the entire printer from increasing.

However, the printer of the off-carriage ink supply system requires its ink cartridge to be mounted in a limited space within the frame of the printer. This limits the capacity of the ink cartridge. Thus, to continuously print a large volume of printed matter, the ink cartridge must be frequently replaced. Such work is troublesome.

Patent documents 1 and 2 disclose ink supply apparatuses that have been proposed to overcome such a problem. In the ink supply apparatus of patent document 1, a tank having a plurality of ink supply cartridges on its base is arranged outside the printer. An ink supply duct is connected to each ink supply cartridge. The ink supply ducts are connected to the ink cartridges of the printer so as to automatically supply ink from the ink supply cartridges to the ink cartridges of the printer via the ink supply ducts.

In the ink supply apparatus of patent document 2, instead of an ink cartridge, an attachment is attached to a carriage of a printer, and ink is supplied from an external ink tank to the attachment.

In the printers of these types, an apparatus for drawing in waste ink is arranged in a region outside the print range (at a location corresponding to the home position of the recording head) at one side of the frame to prevent ink from drying and hardening in the nozzle portion of the recording head, which functions as an ejection head. This waste ink suction apparatus includes a suction pump and a waste liquid tank connected to the suction pump by a duct. Ink is drawn in from the nozzles of the recording head by the suction pump, and the ink is collected in the waste liquid tank as waste liquid.

However, in a printer employing such a waste ink suction apparatus, the waste liquid tank is arranged in a limited space within the frame. This limits the collection capacity of the waste liquid. Thus, even when the printer includes the ink supply apparatus of the above-described patent document 1 or patent document 2 to continuously print a large volume of printed matter, the limited capacity of the waste ink suction apparatus that collects the waste liquid makes it difficult to perform large-volume printing.

The ink supply apparatus of patent document 1, which requires the ink supply ducts to be connected to the ink cartridges of the printer, has the problem described below.

When the printer uses the off-carriage ink supply system, the distal end of each ink supply duct must be directly connected to the corresponding ink cartridge on the printer. However, the structure of the ink cartridge is not applicable for such connection. Thus, for example, the user is required to process the ink cartridge in order to connect the ink duct to the ink cartridge. Such preprocessing for the connection is extremely troublesome.

The ink supply apparatus of patent document 1 used in a printer of the on-carriage ink supply system also requires each ink supply duct to be connected to the corresponding ink cartridge on the carriage, and the preprocessing for enabling the connection is as troublesome as in the case of the off-carriage ink supply system.

Further, the ink supply system of patent document 2 has the attachment mounted on the carriage instead of the ink cartridge as described above, and a tube extending from the ink tank is connected to the attachment. However, in the ink supply system of patent document 2, the weight held by the carriage greatly differs from the weight held when an ink cartridge is mounted on the carriage. This may adversely affect the operation of the carriage and lower the printing quality. Further, the tube, which extends from the ink tank that is arranged outside the printer, is connected to the cartridge on the carriage in the structure of patent document 2. Thus, the tube may be an obstruction when closing a cover, which is located above a carriage moving region. As a result, dust may easily enter the printer, and the aesthetic appeal of the printer may be lowered. In particular, the carriage reciprocates in a state in which the tube is connected to the attachment on the carriage in the structure of patent document 2. Thus, the tube is also moved whenever the carriage reciprocates. In this case, if the external ink tank is installed at an improper position, the movement of the carriage may forcibly pull or bend the tube. This may consequently generate excessive load when the carriage moves or interfere with the smooth supply of ink. In such a case, this would hinder high-quality printing.

Patent Document 1: Chinese Registered Utility Model Publication No. CN 2355886

Patent Document 2: Japanese Laid-Open Patent Publication No. 2003-326732

SUMMARY

A first object of the present invention is to provide a waste liquid collection apparatus that enables a waste liquid tank to have a large capacity and to provide a liquid ejection apparatus including the waste liquid collection apparatus. A second object of the present invention is to provide a transfer device for enabling easy connection to a waste liquid tank and to provide a liquid ejection apparatus including the transfer device. A third object of the present invention is to provide a transfer device for ensuring simple connection of an ejection head and a tank storing liquid supplied to the ejection head without causing any of the problems described above and to provide a liquid ejection apparatus including the transfer device.

To achieve the first object, the present invention provides a waste liquid collection apparatus for use in a state arranged outside a liquid ejection mechanism. The waste liquid collection apparatus has a waste liquid tank including a connection port connectable to a discharge side of a suction pump that draws in liquid from a nozzle of an ejection head arranged in the liquid ejection mechanism.

The present invention also provides a liquid ejection apparatus. The liquid ejection apparatus has a liquid ejection mechanism including an ejection head for ejecting liquid from a nozzle and a suction pump for drawing in liquid from the nozzle of the ejection head when the ejection head is not ejecting liquid, and the above waste liquid collection apparatus.

To achieve the second object, the present invention provides a transfer device including a waste liquid transfer passage having an upstream end and a downstream end. The upstream end of the waste liquid transfer passage includes a pump side connection port connected to a discharge side of a suction pump for drawing in liquid from a nozzle of an ejection head, and the downstream end of the waste liquid transfer passage includes a discharge port for discharging the liquid drawn in by the suction pump.

The present invention also provides a liquid ejection apparatus. The liquid ejection apparatus includes an ejection head for ejecting liquid, and a suction pump for drawing in liquid from a nozzle of the ejection head. The suction pump has a discharge side connected by a duct to the pump side connection port of the above transfer device.

To achieve the third object, the present invention provides a transfer device including a transfer passage having an upstream end and a downstream end. The upstream end of the transfer passage includes a tank side connection port connected to a duct extending from a tank containing liquid, and the downstream end of the transfer passage includes a head side connection port connected to a duct extending from an ejection head for ejecting liquid supplied from the tank.

The present invention further provides a liquid ejection apparatus. The liquid ejection apparatus includes an ejection head for ejecting liquid onto a target, and an apparatus frame including an attaching portion. The above transfer device is attached to the attaching portion, and the head side connection port of the transfer device is connected by a duct to the ejection head.

DESCRIPTION OF EXEMPLARY EMBODIMENTS

A first embodiment of the present invention will now be described with reference to FIGS. 1 to 4.

Figure 1:
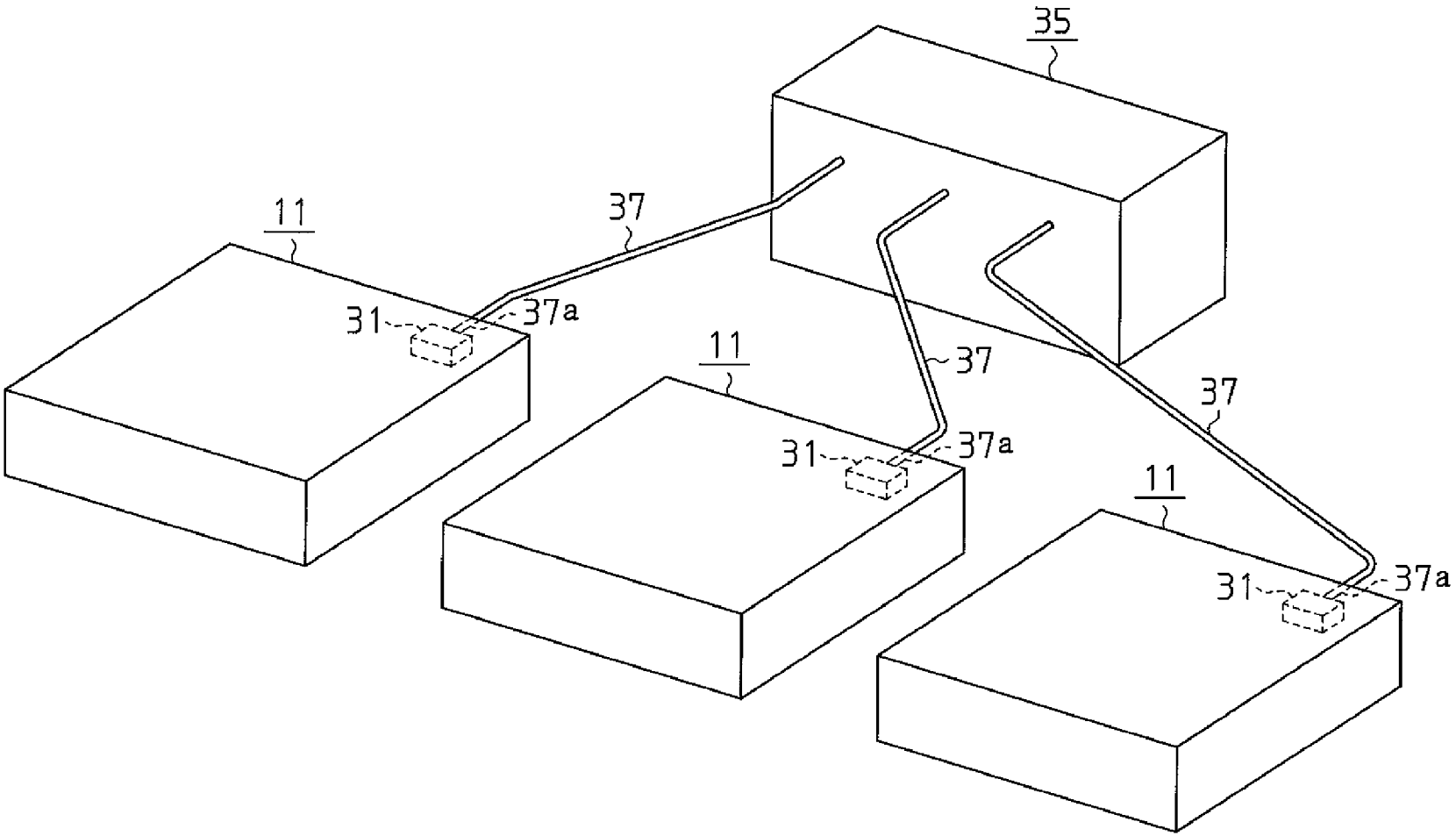
FIG. 1 is a schematic perspective view of a printer system according to a first embodiment of the present invention.

As shown in FIG. 1, a printer system serving as a liquid ejection system according to a first embodiment of the present invention includes inkjet printers 11 functioning as a plurality of liquid ejection apparatuses arranged in parallel. A single waste liquid tank 35 forming a waste liquid collection apparatus is arranged behind the printers 11. A plurality of second waste liquid ducts 37 extend from the waste liquid tank 35. Each second waste liquid duct 37 has a distal end detachably connected to a transfer device 31 for waste liquid arranged in a rear portion of the corresponding printer 11.

Figure 2:
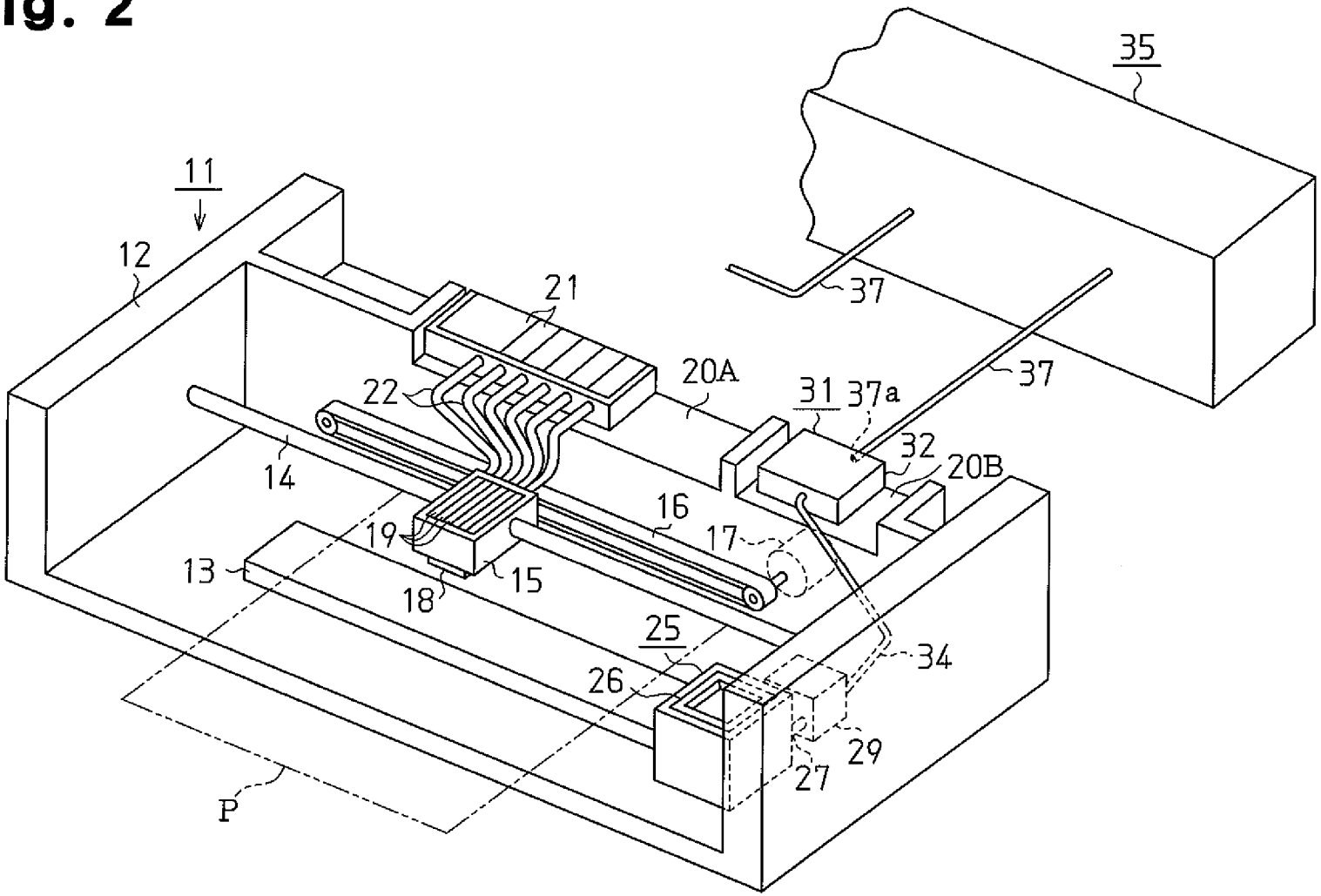
FIG. 2 is an enlarged perspective view of a printer included in the printer system of FIG. 1.

As shown in FIG. 2, in each printer 11, a platen 13 is arranged on a frame 12, and a paper feeding mechanism (not shown) feeds a paper P, which functions as a print medium, onto the platen 13. A guide member 14 is arranged on the frame 12 to extend in parallel to the platen 13, and a carriage 15 is movably supported on the guide member 14. The carriage 15 is operably connected to a carriage motor 17 by a timing belt 16. The carriage 15 reciprocates within a predetermined range along the guide member 14 when the carriage motor 17 is driven.

A recording head 18, which functions as an ejection head that forms a liquid ejection mechanism, is mounted on the surface of the carriage 15 facing the platen 13. Six valve units 19 for supplying ink, which functions as a liquid, to the recording head 18 are mounted on the carriage 15. The valve units 19 temporary store six colors (six kinds) of ink used in the printer 11. The recording head 18 has a plurality of nozzles arranged on its lower side (not shown), and ink is ejected in dots from the nozzles onto the paper P, which functions as a target, through the valve units 19 to perform printing.

As shown in FIG. 2, a first attaching portion 20A and a second attaching portion 20B are defined by recesses in the rear portion of the frame 12. Six ink cartridges 21 are detachably attached to one side of the first attaching portion 20A. The ink cartridges 21 contain different colors of ink. A supply duct 22, which is formed by a flexible tube, is connected to each ink cartridge 21. Each supply duct 22 has a distal end connected to the corresponding valve unit 19 of the recording head 18. The air pressure generated by a pressurizing pump (not shown) supplies ink from each ink cartridge 21 to the corresponding valve unit 19 of the recording head 18 through the corresponding supply duct 22.

Figure 3:
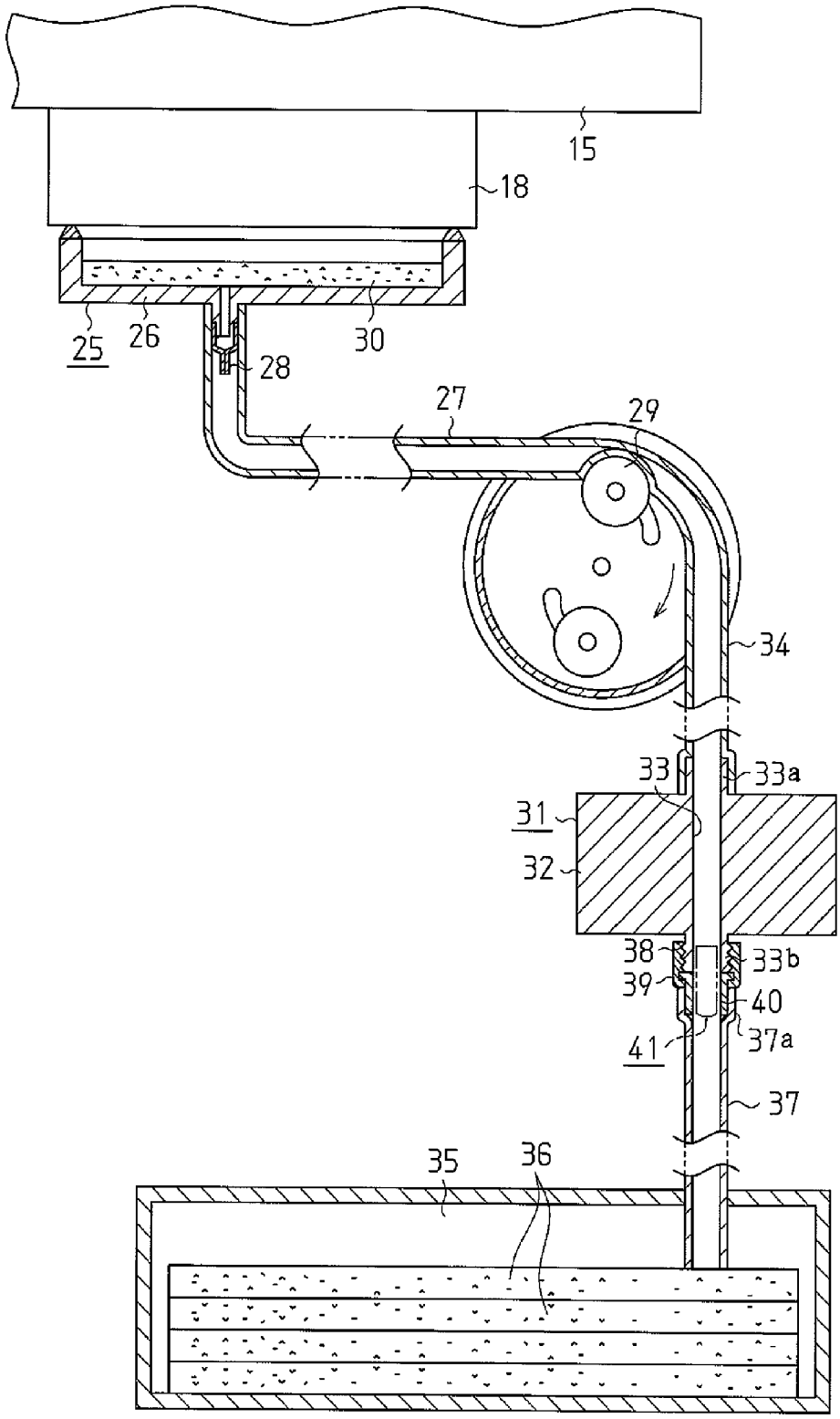
FIG. 3 is an enlarged cross-sectional view of an essential part of the printer of FIG. 2 showing an ink suction apparatus and a waste liquid collection apparatus.

As shown in FIGS. 2 and 3, an ink suction apparatus 25 for drawing in ink from the nozzles of the recording head 18 is arranged at a location corresponding to a home position of the recording head 18 at one side of the frame 12 in a region that is outside a print range. The ink suction apparatus 25 includes a flat and substantially square box-shape cap 26, which has an open top surface, an ink tube 27, which extends from the bottom of the cap 26, a check valve 28, which is arranged near the inlet of the ink tube 27, and a suction pump 29, which is a tube pump forming part of the liquid ejection mechanism near the outlet of the ink tube 27. An absorbent (sponge) 30 containing ink is arranged in the cap 26. The carriage 15 is moved to the home position when printing is suspended, and a drive means (not shown) raises the cap 26 to cover the nozzles of the recording head 18. This prevents the ink remaining in the nozzles from drying.

As shown in FIGS. 2 and 3, the transfer device 31 for waste liquid is detachably attached to the second attaching portion 20B of the frame 12. The transfer device 31 has a rear surface exposed from the frame 12. Further, the transfer device 31 has a square block-shaped main body 32. A waste liquid transfer passage 33 is formed in the main body 32. A cylindrical pump side connection port 33*a*, which is located at the front end of the waste liquid transfer passage 33, projects from the main body 32. A cylindrical discharge port 33*b*, which is located at the rear end of the waste liquid transfer passage 33, projects from the main body 32. The pump side connection port 33*a* is connected to the suction pump 29 (more specifically, to the discharge side of the suction pump 29) by a first waste liquid duct 34, which is formed by a flexible tube.

Figure 4:
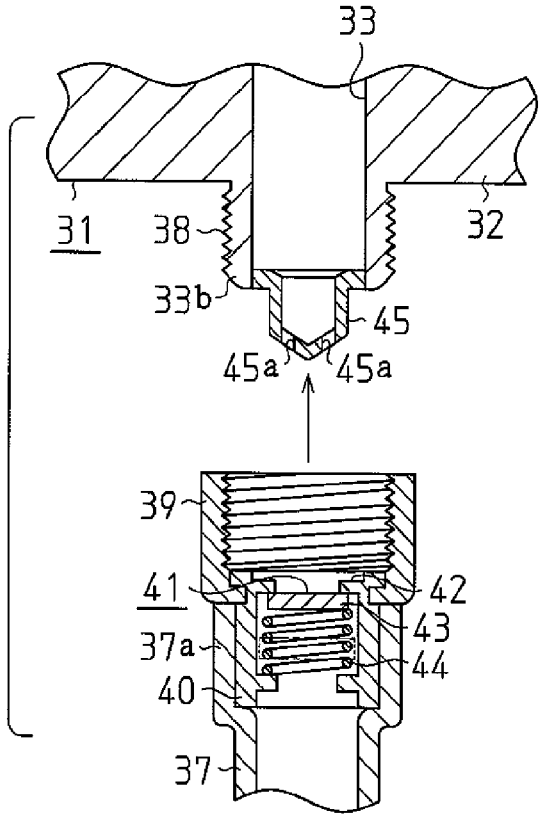
FIG. 4 is an enlarged exploded cross-sectional view of an essential part of the waste liquid collection apparatus of FIG. 3 showing a valve mechanism of a transfer device.

The waste liquid tank 35 forming a waste liquid collection apparatus is arranged behind the frame 12 outside the frame 12, and ink absorbents 36 are stacked in the waste liquid tank 35. The second waste liquid duct 37, which extends from the waste liquid tank 35, is formed by a flexible tube. The second waste liquid duct 37 has a distal end forming a connection port 37*a* (in other words, a connection port 37*a* of the waste liquid tank 35) that is detachably connected to the discharge port 33*b* of the transfer device 31. In more detail, as shown in FIGS. 3 and 4, a threaded portion 38 is formed on an outer circumference of the discharge port 33*b* of the transfer device 31, and a nut 39 is rotatably attached to the connection port 37*a*, which functions as a head side connection port of the second waste liquid duct 37, with a support tube 40 arranged in between. The nut 39 is mated with the threaded portion 38 so that the connection port 37*a* of the second waste liquid duct 37 is detachably connected to the discharge port 33*b* of the transfer device 31.

A valve mechanism 41 functioning as a closing means is arranged in the connection between the discharge port 33*b* of the transfer device 31 and the connection port 37*a* of the second waste liquid duct 37. The valve mechanism 41 includes a valve seat 42 arranged in the support tube 40, a valve member 43 arranged to face the valve seat 42 so that the valve member 43 can be in contact with or spaced from the valve seat 42, a spring 44 for urging the valve member 43 toward the valve seat 42, and an open/close dog 45 having through holes 45*a* and formed on the discharge port 33*b* of the transfer device 31 to move the valve member 43. When the connection port 37*a* of the second waste liquid duct 37 is connected to the discharge port 33*b* of the transfer device 31, the valve member 43 is pressed by the open/close dog 45 and spaced from the valve seat 42. This opens the valve mechanism 41. That is, the connection port 37*a* of the second waste liquid duct 37 opens. When the connection port 37*a* is disconnected from the discharge port 33*b*, the urging force of the spring 44 causes the valve member 43 to contact the valve seat 42 and closes the valve mechanism 41. That is, the connection port 37*a* of the second waste liquid duct 37 closes.

When the cap 26 covers the nozzles of the recording head 18 and the suction pump 29 is driven while the connection port 37*a* of the second waste liquid duct 37 is connected to the discharge port 33*b* of the transfer device 31, highly viscous ink, dust, and the like in the vicinity of the nozzles of the recording head 18 are drawn into the ink tube 27 by the suction pump 29. The drawn in ink and the like are discharged to the waste liquid tank 35 as a waste liquid through the first waste liquid duct 34, the waste liquid transfer passage 33, and the second waste liquid duct 37 and collected in the waste liquid tank 35 in a state absorbed in the absorbents 36.

The operation of the printer 11 including the waste liquid collection apparatus with the above-described structure will now be described.

In the states shown in FIGS. 2 and 3, the connection port 37*a* at the distal end of the second waste liquid duct 37 extending from the waste liquid tank 35, which is arranged behind the frame 12, is connected to the discharge port 33*b* of the transfer device 31. When the printer 11 performs a printing operation in this state, the carriage 15 moves along the guide member 14, and the ink stored in each ink cartridge 21 is supplied to the corresponding valve unit 19 by the corresponding supply duct 22 so that ink is ejected from the nozzles of the recording head 18 onto the paper P to perform printing.

When the printing operation of the printer 11 is suspended, the carriage 15 moves to the home position that corresponds to the cap 26 of the ink suction apparatus 25. Then, the cap 26 covers the nozzles of the recording head 18 as shown in FIG. 3 to prevent the nozzles from drying.

When a switch for cleaning the nozzles of the recording head 18 is operated, a predetermined timing is reached during printing, or the ink cartridge 21 is replaced, the carriage 15 moves to the home position and the cap 26 covers the nozzles of the recording head 18 in the same manner as when the printing operation is suspended.

When the suction pump 29 is driven in a state in which the nozzles are covered by the cap 26, highly viscous ink, dust, and the like in the vicinity of the nozzles are drawn in, and the drawn in ink and the like are discharged to the waste liquid tank 35 via the first waste liquid duct 34, the waste liquid transfer passage 33, and the second waste liquid duct 37 and collected in the waste liquid tank 35 in a state absorbed in the absorbents 36.

In the present embodiment, the waste liquid tank 35 is arranged outside the frame 12 of the printer 11. Thus, the capacity of the waste liquid tank 35 is not limited by the accommodation space in the frame 12. Accordingly, when the waste liquid tank 35 having a large capacity is used, the waste liquid drawn in from the nozzles of the recording head 18 by the suction pump 29 can be continuously collected in the waste liquid tank 35.

When the waste liquid tank 35 becomes full with waste liquid, the waste liquid tank 35 must be replaced. In such a case, the nut 39 on the distal end of the second waste liquid duct 37 extending from the waste liquid tank 35, which has become full, is removed from the threaded portion 38 of the discharge port 33*b* of the transfer device 31. Then, the connection port 37*a* on the distal end of the second waste liquid duct 37 is disconnected from the discharge port 33*b*. Afterwards, the waste liquid tank 35 that is full is replaced with another empty waste liquid tank, and a nut on a distal end of a second waste liquid duct extending from the empty waste liquid tank is mated with the threaded portion 38 of the discharge port 33*b* of the transfer device 31. Then, a connection port 37*a* of the second waste liquid duct is connected to the discharge port 33*b*.

As described above, in the present embodiment, the second waste liquid duct 37 extending from the waste liquid tank 35 via the transfer device 31 is connected to and disconnected from the first waste liquid duct 34 extending from the discharge side of the suction pump 29. The waste liquid ducts 34 and 37 are connected or disconnected in a simple and ensured manner. This facilitates replacement of the waste liquid tank 35. Further, the second waste liquid duct 37 is formed by a flexible tube. Thus, the second waste liquid duct 37 is easily connected to or disconnected from the discharge port 33*b* of the transfer device 31 and the replacement of the waste liquid tank 35 is facilitated wherever the waste liquid tank 35 is located behind the frame 12. Further, the valve mechanism 41 is arranged in the connection between the connection port 37*a* of the second waste liquid duct 37 and the discharge port 33*b* of the transfer device 31, and the valve mechanism 41 closes when the connection is disconnected. Thus, the waste liquid is prevented from leaking when the waste liquid tank 35 is replaced.

The first embodiment has the advantages described below.

The large-capacity waste liquid tank 35 is arranged at outside the plurality of printers 11, and the waste liquid tank 35 is connected to the suction pump 29 of each printer 11. As a result, the ink drawn in from the nozzles of the recording head 18 is continuously collected in the waste liquid tank 35 so that large-volume printing can be continuously performed. Further, only one waste liquid tank 35 is arranged for the plurality of printers 11, the entire system may be miniaturized and the structure may be simplified. Further, each printer 11 does not need to include the waste liquid tank 35. This enables the size of each printer 11 to be reduced.

The connection port 37*a* of the second waste liquid duct 37 of the waste liquid tank 35 is connected to or disconnected from the discharge port 33*b* of the transfer device 31, that is, the discharge side of the suction pump 29, so that the waste liquid tank 35 can be easily connected to or disconnected from the discharge side of the suction pump 29. Thus, the waste liquid tank 35 can be replaced easily.

The connection port 37*a* of the waste liquid tank 35 is arranged at the distal end of the second waste liquid duct 37, which is formed by a flexible tube (in other words, the second waste liquid duct 37 is formed by a flexible tube). Thus, the flexible tube can be bent, and the waste liquid tank 35 can be arranged at any position outside the printer 11 and the connection port 37*a* of the second waste liquid duct 37 and be easily connected to the discharge port 33*b* of the transfer device 31.

The valve mechanism 41 for opening the connection port 37*a* when the second waste liquid duct 37 is connected to the transfer device 31 and closing the connection port 37*a* when the second waste liquid duct 37 is disconnected from the transfer device 31 is arranged in the connection port 37*a* of the second waste liquid duct 37. Thus, the ink is prevented from leaking when the waste liquid tank 35 is replaced by disconnecting the connection port 37*a* from the discharge port 33*b* of the transfer device 31.

A second embodiment of the present invention will now be described focusing on differences from the first embodiment.

Figure 5:
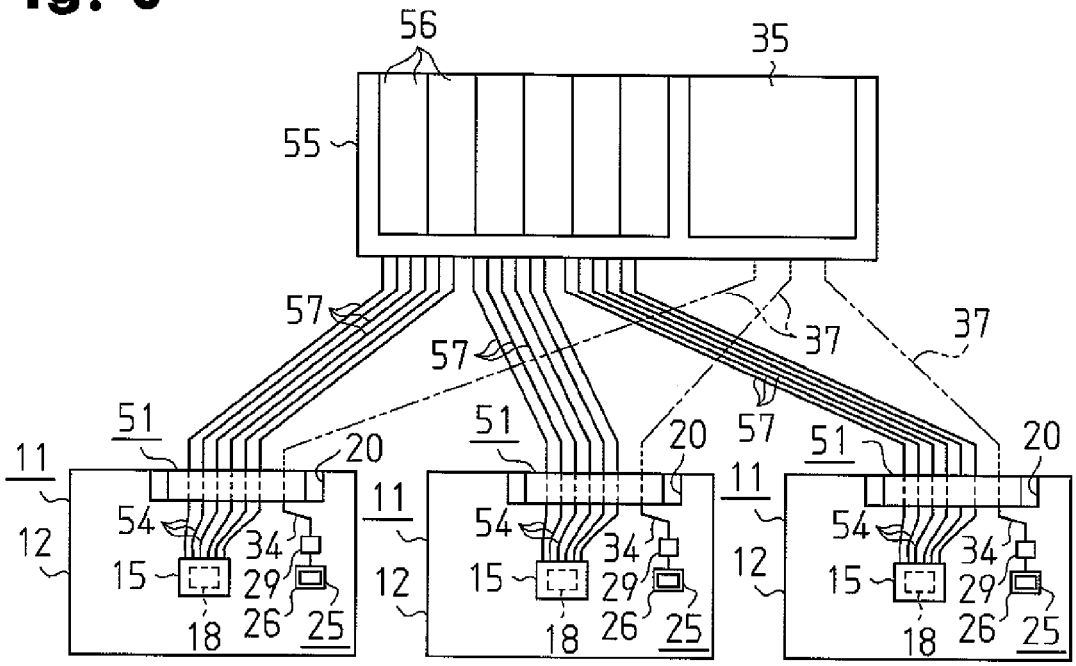
FIG. 5 is a schematic plan view of a printer system according to a second embodiment of the present invention.
Figure 6:
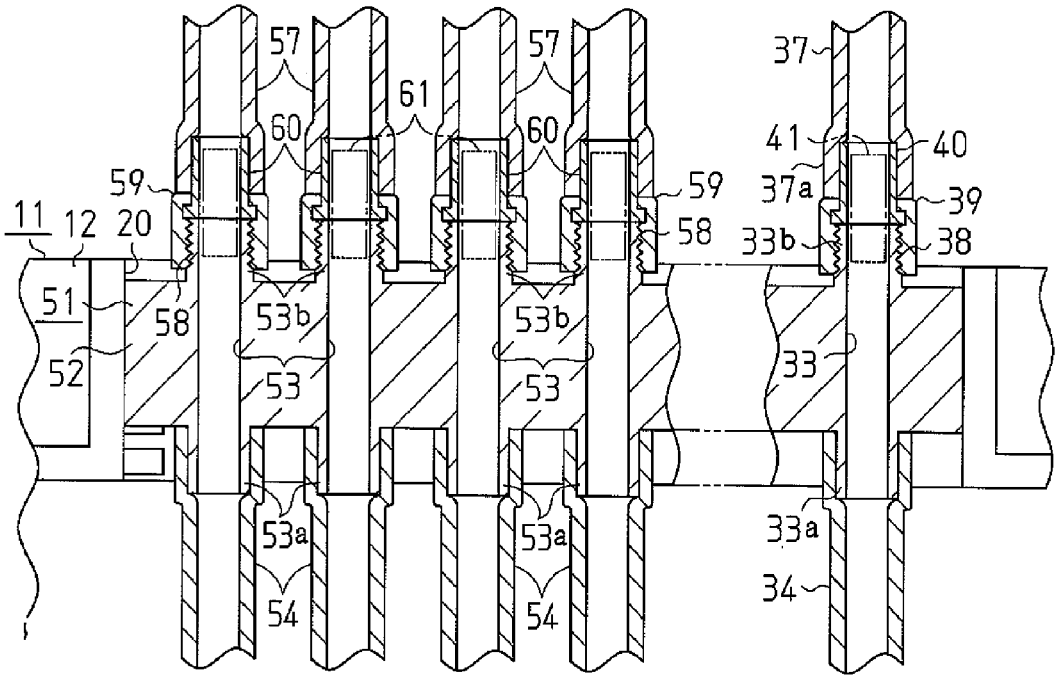
FIG. 6 is an enlarged cross-sectional view of a part of a printer included the printer system of FIG. 5 showing a transfer device.
Figure 7:
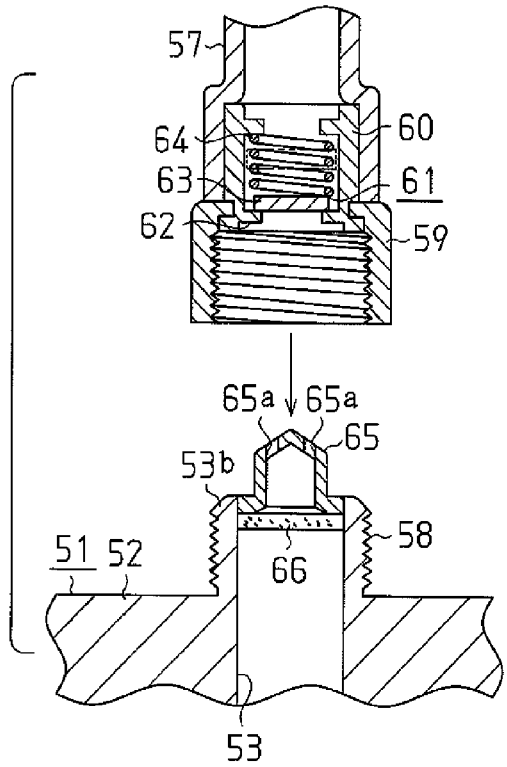
FIG. 7 is an enlarged exploded cross-sectional view of an essential part of the transfer device of FIG. 6 showing a valve mechanism.

A printer system of the second embodiment does not include the ink cartridges 21 of the first embodiment as shown in FIGS. 5 to 7. Further, an attaching portion 20 is arranged at a rear portion of a frame 12 in lieu of the first attaching portion 20A and the second attaching portion 20B in the first embodiment. A transfer device 51 used commonly for the supplied liquid and the waste liquid is detachably attached to the attaching portion 20 in lieu of the transfer device 31 for waste liquid in the first embodiment. A rear surface of the transfer device 51 is exposed from the frame 12. A single waste liquid transfer passage 33 that is the same as that in the first embodiment and a plurality of supply liquid transfer passages 53 are formed in parallel at predetermined intervals within a main body 52 of the transfer device 51. A cylindrical pump side connection port 33*a* is formed at a front end of the waste liquid transfer passage 33 and projects from the main body 52. A cylindrical discharge port 33*b* is formed at a rear end of the waste liquid transfer passage 33 and projects from the main body 52. The pump side connection port 33*a* is connected to a suction pump 29 by a first waste liquid duct 34, which is formed by a flexible tube. A head side connection port 53*a*, which is cylindrical, is formed at a front end of each supply liquid transfer passage 53 and project from the main body 52. A cylindrical tank side connection port 53*b* is formed at a rear end of each supply liquid transfer passage 53 and projects from the main body 52. An upstream end of a first supply duct 54, which is formed by a flexible tube, is connected and fixed to the head side connection port 53*a* of each supply liquid transfer passage 53, and a downstream end of each first supply duct 54 is connected to a corresponding valve unit 19 of a recording head 18.

A tank holder 55, which is formed by a case, is arranged behind the frame 12. The tank holder 55 accommodates a waste liquid tank 35 that is the same as that in the first embodiment and six large-capacity supply liquid tanks 56 containing different colors of ink in a manner that each tank is removable independently. More specifically, the tanks 35 and 56 are integrated together in a state accommodated in the tank holder 55. A downstream end of a second waste liquid duct 37, which is formed by a flexible tube, is connected and fixed to the waste liquid tank 35, and an upstream end of each second waste liquid duct 37 is detachably connected to the discharge port 33*b* of the waste liquid transfer passage 33 of the corresponding transfer device 51. An upstream end of a second supply duct 57, which is formed by a flexible tube, is connected and fixed to each supply liquid tank 56, and a downstream end of each second supply duct 57 is detachably connected to the tank side connection port 53*b* of the corresponding supply liquid transfer passage 53 of the transfer device 51. In more detail, in the same manner as the connection between each transfer device 31 and the corresponding second waste liquid duct 37 in the first embodiment, a threaded portion 38 formed on an outer circumference of the discharge port 33*b* is mated with a nut 39 rotatably attached to a distal end of the second waste liquid duct 37 with a support tube 40 arranged in between. A threaded portion 58 formed on an outer circumference of the tank side connection port 53*b* is mated with a nut 59 rotatably attached to a distal end of each second supply duct 57 with a support tube 60 arranged in between. Thus, the second waste liquid duct 37 is detachably connected to the discharge port 33*b*, and each second supply duct 57 is detachably connected to the corresponding tank side connection port 53*b*.

A valve mechanism 61 functioning as a closing means is arranged in a connection between each second supply duct 57 and the corresponding tank side connection port 53*b*. The valve mechanism 61 includes a valve seat 62 arranged in the support tube 60 of the second supply duct 57, a valve member 63, a spring 64, and an open/close dog 65 having through-holes 65*a* formed on the tank side connection port 53*b* in the same manner as the valve mechanism 41 of the first embodiment. When the second supply duct 57 is connected to the tank side connection port 53*b* (in other words, when the supply liquid tank 56 is connected to the recording head 18), the valve member 63 is pressed by the open/close dog 65 and spaced from the valve seat 62. As a result, the valve mechanism 61 opens. That is, the second supply duct 57 opens. When the second supply duct 57 is disconnected from the tank side connection port 53*b* (in other words, when the supply liquid tank 56 is disconnected from the recording head 18), the urging force of the spring 64 causes the valve member 63 to contact the valve seat 62. This closes the valve mechanism 61. More specifically, the second supply duct 57 closes. A valve mechanism 41 that is the same as that in the first embodiment is arranged in the connection between the second waste liquid duct 37 and the discharge port 33*b*.

A filter 66 is arranged in each tank side connection port 53*b* so that the filter 66 is located in the corresponding supply liquid transfer passage 53. When each second supply duct 57 is connected to the tank side connection port 53*b* of the transfer device 51, the air pressure from a pressurizing pump (not shown) supplies ink from each supply liquid tank 56 to the corresponding valve unit 19 of the recording head 18 through the corresponding second supply duct 57, the transfer device 51, and the corresponding first supply duct 54. In this case, the filter 66 removes impurities and the like from the ink in the supply liquid transfer passage 53 of the transfer device 51.

In the second embodiment, the supply liquid tanks 56 are arranged outside the frame 12 of the printer 11. Thus, the capacity of the supply liquid tanks 56 is not limited by the accommodation space in the frame 12. When supply liquid tanks 56 having a large capacity are used, ink can be supplied continuously to the recording head 18 without requiring the supply liquid tanks 56 to be replaced frequently, and large-volume printing can be continuously performed. Further, each first supply duct 54 is formed by a flexible tube. Thus, the first supply duct 54 easily bends as it follows the movement of the recording head 18 when printing is performed. Thus, the first supply duct 54 does not obstruct movement of the recording head 18 or the supply of ink.

Further, in the second embodiment, the waste liquid tank 35 and the supply liquid tanks 56 are accommodated and supported in the tank holder 55 in a removable manner, and the waste liquid tank 35 and the supply liquid tanks 56 are integrated together in a state accommodated in the tank holder 55. Thus, the waste liquid tank 35 and the supply liquid tanks 56 may be arranged in a manner concentrated at one position. This facilitates the attachment, removal, and replacement of the tanks 35 and 56.

When all of the ink in a supply liquid tank 56 is consumed, the supply liquid tank 56 must be replaced. In that case, the nut 59 on the distal end of the second supply duct 57 extending from the supply liquid tank 56 is removed from the threaded portion 58 of the tank side connection port 53*b* of the transfer device 51, and the second supply duct 57 is disconnected from the transfer device 51. Afterwards, a nut on a distal end of a second supply duct extending from another supply liquid tank that is filled with ink is mated with the threaded portion 58 of the tank side connection port 53*b* of the transfer device 51. In this manner, the second supply duct 57 and the tank side connection port 53*b* of the transfer device 51 are easily connected and disconnected. Thus, the empty supply liquid tank 56 is replaced with another supply liquid tank that is filled with ink. Further, each second supply duct 57 is formed by a flexible tube. Thus, the second supply duct 57 can be easily connected to and disconnected from the tank side connection port 53*b* wherever the supply liquid tanks 56 are arranged behind the frame 12. This facilitates the replacement of the supply liquid tanks 56. Further, the valve mechanism 61 is arranged in the connection between the distal end of the second supply duct 57 and the tank side connection port 53*b* of the transfer device 51, and the valve mechanism 61 closes when the connection is disconnected. Thus, the ink is prevented from leaking when the supply liquid tank 56 is replaced.

The second embodiment has the advantages described below in addition to the advantages of the first embodiment.

The printer system of the second embodiment includes the supply liquid tanks 56, each of which contains a large amount of ink that is supplied to the recording head 18. Thus, the printer can continuously supply ink from the supply liquid tanks 56 to the recording head 18 and continuously perform large-volume printing.

Each second supply duct 57 between the supply liquid tank 56 and the transfer device 51 is formed by a flexible tube. Thus, the flexible tube can be bent, and the supply liquid tanks 56 can be arranged at any position. Further, the supply liquid tanks 56 can be easily connected to the transfer device 51.

The valve mechanism 61, which opens when connected to the transfer device 51 and closes when disconnected from the transfer device 51, is arranged in the upstream end of the second supply duct 57. Thus, ink is prevented from leaking when the supply liquid tank 56 is replaced.

The waste liquid tank 35 and the supply liquid tanks 56 are detachably supported on the single tank holder 55. Thus, the entire tank may be miniaturized, and replacement of the waste liquid tank 35 and the supply liquid tanks 56 is facilitated.

The first and second embodiments may be modified as described below.

Although six valve units 19 are arranged on the recording head 18 and six ink cartridges 21 are mounted on the frame 12 in the first embodiment, any number of valve units 19 and any number of ink cartridges 21 may be used. For example, a printer for single color printing may include a single valve unit 19 and a single ink cartridge 21, and a printer that performs printing with the four colors of black, cyan, magenta, and yellow may include four valve units 19 and four ink cartridges 21.

Although six valve units 19 are arranged on the recording head 18 and six supply liquid tanks 56 are mounted on the tank holder 55 in the second embodiment, any number of valve units 19 and any number of supply liquid tanks 56 may be used. For example, a printer for single color printing may include a single valve unit 19 and a single supply liquid tank 56, and a printer that performs printing with the four colors of black, cyan, magenta, and yellow may include four valve units 19 and four supply liquid tanks 56.

In the first embodiment, the transfer device 31 may be detachably attached to the attaching portions 20A and 20B at the rear portion of the frame 12. In this case, the pump side connection port 33*a* projecting from the front surface of the transfer device 31 must be detachable from the first waste liquid duct 34.

In the second embodiment, the transfer device 51 may be detachably attached to the attaching portion 20 at the rear portion of the frame 12. In this case, the head side connection port 53*a* projecting from the front surface of the transfer device 51 must be detachable from the first supply duct 54.

In the second embodiment, a transfer device for ink and a transfer device for a waste liquid may be attached to the attaching portion 20 at the rear portion of the frame 12 instead of the transfer device 51 commonly used for ink and waste liquid.

In the second embodiment, the supply liquid tanks 56 and the waste liquid tank 35 are accommodated and supported in the single tank holder 55 in a removable manner. However, the tanks 56 and 35 may be arranged at separate positions at the rear side of the frame 12 of the printer 11.

In the first and second embodiments, the printer system is formed by the printers 11 that are independent from one another, and each printer 11 is connected to the single waste liquid tank 35 by a duct 37. However, the printer system may be formed by a plurality of printer mechanisms, each having a recording head and arranged on the same frame. Each printer mechanism may be connected to a single waste liquid tank 35 arranged behind the frame.

Instead of connecting more than one printer 11 to the waste liquid tank 35, only one printer 11 may be connected to the waste liquid tank 35.

In the first and second embodiments, the pressurizing pump for supplying ink from the supply liquid tanks 56 is used. However, ink may be supplied using height difference instead of using the pressurizing pump.

Portions of the supply duct 22, the first waste liquid duct 34, the second waste liquid duct 37, the first supply duct 54, and the second supply duct 57 may be formed by flexible tubes, and the remaining portions may be formed from a rigid body made of metal such as stainless steel or hard synthetic resin.

The valve mechanisms 41 and 61 in the first and second embodiments may be eliminated. In this case, a cap may be arranged to close the open end of the supply duct 22, the first waste liquid duct 34, the second waste liquid duct 37, the first supply duct 54, the second supply duct 57, the waste liquid transfer passage 33, or the supply liquid transfer passage 53 when the opening is exposed. In this case, the cap functions as a closing means.

The inkjet printers 11 of the first and second embodiments may be replaced by liquid ejection apparatuses for ejecting liquids other than ink. For example, the inkjet printer 11 may be a liquid ejection apparatus for ejecting liquid such as an electrode material or a color material used to manufacture, for example, a liquid crystal display, an EL (electroluminescence) display, or an FED (field emission display); a liquid ejection apparatus for ejecting living organisms for use in manufacturing a biochip; or a sample ejection apparatus such as a precision pipette.

A third embodiment of the present invention will now be described with reference to FIGS. 8 to 10.

Figure 8:
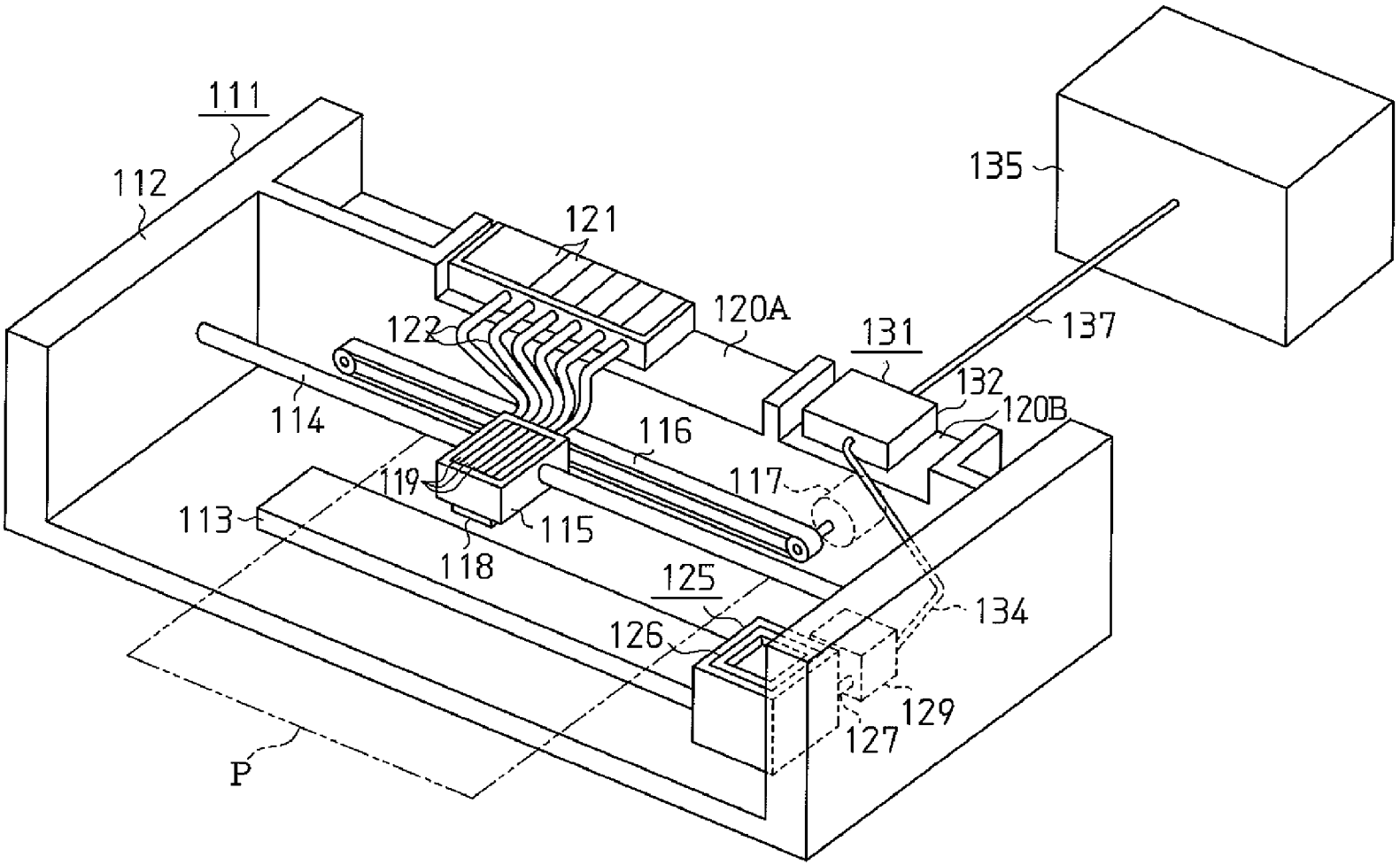
FIG. 8 is a perspective view of a printer according to a third embodiment of the present invention.

As shown in FIG. 8, in an inkjet printer 111 functioning as liquid ejection apparatus of the third embodiment, a platen 113 is arranged on a frame 112, and a paper feeding mechanism (not shown) feeds a paper P, which functions as a print medium, onto the platen 113. A guide member 114 is arranged on the frame 112 so as to extend parallel to the platen 113, and a carriage 115 is movably supported on the guide member 114. The carriage 115 is operably connected to a carriage motor 117 by a timing belt 116. The carriage 115 reciprocates within a predetermined range along the guide member 114 when the carriage motor 117 is driven.

A recording head 118 functioning as an ejection head is mounted on a surface of the carriage 115 facing the platen 113. Six valve units 119 for supplying ink as liquid to the recording head 118 are mounted on the carriage 115. The valve units 119 temporary contain six colors of ink (six kinds) used in the printer 111. The recording head 118 has a plurality of nozzles on its lower side (not shown), and ink is ejected in dots from the nozzles onto the paper P, which functions as a target, to perform printing.

As shown in FIG. 8, a first attaching portion 120A and a second attaching portion 120B are defined by recesses formed in a rear portion of the frame 112. Six ink cartridges 121 are detachably attached to one side of the first attaching portion 120A, and the ink cartridges 121 contain ink of six different colors. A supply duct 122, which is formed by a flexible tube, is connected to each ink cartridge 121. Each supply duct 122 has a distal end connected to the corresponding valve unit 119 of the recording head 118. The air pressure from a pressurizing pump (not shown) causes ink to be supplied from each ink cartridge 121 to the corresponding valve unit 119 of the recording head 118 through the corresponding supply duct 122.

Figure 9:
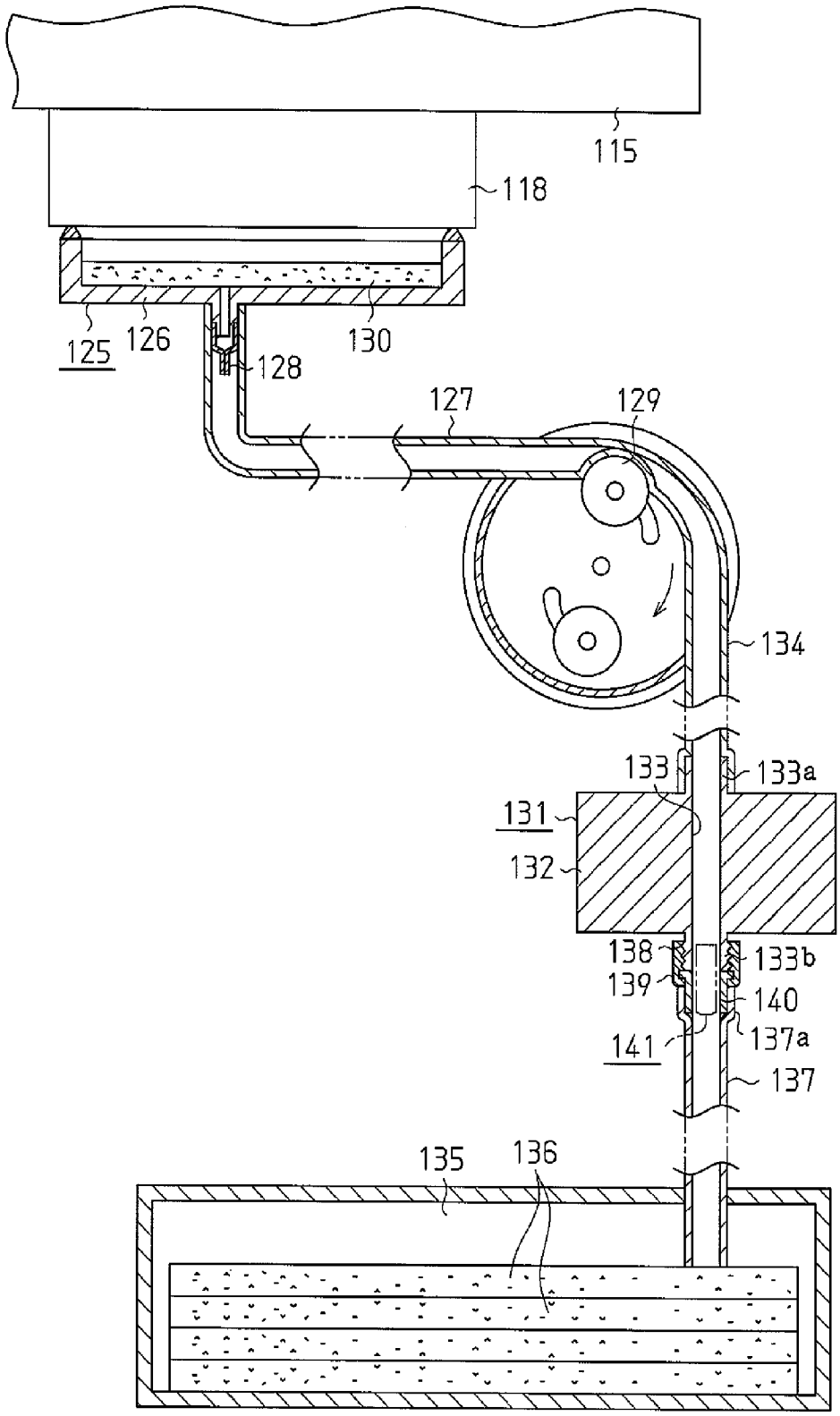
FIG. 9 is an enlarged cross-sectional view of an essential part of the printer of FIG. 8 showing a waste ink suction apparatus.
Figure 10:
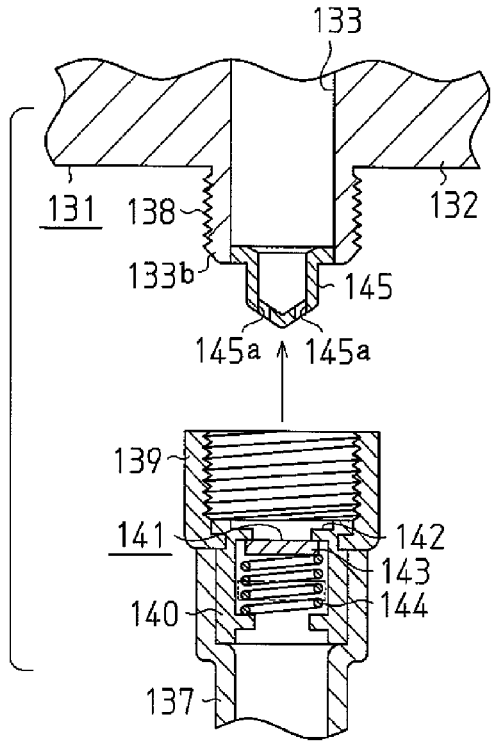
FIG. 10 is an enlarged exploded cross-sectional view of an essential part of the waste ink supply apparatus of FIG. 9 showing a valve mechanism of a transfer device.

As shown in FIGS. 8 and 9, an ink suction apparatus 125 for drawing in ink from the nozzles of the recording head 118 is arranged at one side of the frame 112 at a location corresponding to a home position of the recording head 118 in a region outside a print range. The ink suction apparatus 125 includes a flat and substantially square box-shape cap 126 having a top opening, an ink tube 127 extending from the bottom of the cap 126, a check valve 128 arranged near the inlet of the ink tube 127, and a suction pump 129 formed by a squeeze-type tube pump arranged near the outlet of the ink tube 127. An absorbent (sponge) 130 containing ink is arranged in the cap 126. When printing is suspended and the carriage 115 is moved to the home position, a drive unit (not shown) raises the cap 126 to cover the nozzles of the recording head 118. As a result, the ink remaining in the nozzles is prevented from drying.

As shown in FIGS. 8 and 9, a transfer device 131 for waste liquid is irremovably attached the second attaching portion 120B of the frame 112 in a manner that the transfer device 131. The transfer device 131 has a rear surface exposed from the frame 112. The transfer device 131 has a square block-shaped main body 132. A waste liquid transfer passage 133 is formed in the main body 132. A cylindrical pump side connection port 133*a* formed at the front end (upstream end) of the waste liquid transfer passage 133 projects from the main body 132. A cylindrical discharge port 133*b* formed at the rear end (downstream end) of the waste liquid transfer passage 133 projects from the main body 132. The pump side connection port 133*a* is connected to the suction pump 129 (more specifically, to a discharge side of the suction pump 129) by a first waste liquid duct 134, which is formed by a flexible tube.

A waste liquid tank 135 is arranged behind the frame 112, and ink absorbents 136 are stacked in the waste liquid tank 135. A second waste liquid duct 137 extending from the waste liquid tank 135 is formed by a flexible tube. The second waste liquid duct 137 has a distal end detachably connected to the discharge port 133*b* of the transfer device 131. In more detail, as shown in FIGS. 9 and 10, a threaded portion 138 is formed on an outer circumference of the discharge port 133*b* of the transfer device 131, and a nut 139 is rotatably attached to the distal end of the second waste liquid duct 137 with a support tube 140 arranged in between. The nut 139 is mated with the threaded portion 138 so that the second waste liquid duct 137 is detachably connected to the discharge port 133*b*.

A valve mechanism 141 is arranged in a connection between the discharge port 133*b* of the transfer device 131 and the second waste liquid duct 137. The valve mechanism 141 includes a valve seat 142 arranged in the support tube 140, a valve member 143 arranged to face the valve seat 142 in a manner that the valve member 143 can be in contact with or spaced from the valve seat 142, a spring 144 for urging the valve member 143 toward the valve seat 142, and an open/close dog 145 having through-holes 145*a* and formed in the discharge port 133*b* to move the valve member 143. When the second waste liquid duct 137 is connected to the discharge port 133*b*, the valve member 143 is pressed by the open/close dog 145 and spaced from the valve seat 142. As a result, the valve mechanism 141 opens. That is, the second waste liquid duct 137 opens. When the second waste liquid duct 137 is disconnected from the discharge port 133*b*, the urging force of the spring 144 causes the valve member 143 to contact and close the valve seat 142. That is, the second waste liquid duct 137 closes.

When the cap 126 covers the nozzles of the recording head 118 and the suction pump 129 is driven in a state in which the second waste liquid duct 137 is connected to the discharge port 133*b* of the transfer device 131, highly viscous ink, dust, and the like in the vicinity of the nozzles of the recording head 118 are drawn into the ink tube 127 by the suction pump 129. This maintains the ink ejection function of the recording head 118 in a satisfactory state. The ink and the like drawn in by the suction pump 129 are discharged as waste liquid to the waste liquid tank 135 through the first waste liquid duct 134, the waste liquid transfer passage 133, and the second waste liquid duct 137 and collected in the waste liquid tank 135 in a state absorbed in the absorbents 136.

The operation of the printer 111 including the transfer device 131 will now be described.

In the states shown in FIGS. 8 and 9, the distal end of the second waste liquid duct 137 extending from the waste liquid tank 135, which is arranged behind the frame 112, is connected to the discharge port 133*b* of the transfer device 131. When the printer 111 performs printing in this state, the carriage 115 moves along the guide member 114, and the ink stored in each ink cartridge 121 is supplied to the corresponding valve unit 119 through the corresponding ink supply duct 122 so that ink is ejected in dots from the nozzles of the recording head 118 onto the paper P to perform printing.

When the printing operation of the printer 111 is suspended, the carriage 115 moves to the home position corresponding to the cap 126 of the ink suction apparatus 125. Then, the cap 126 is raised to cover the nozzles of the recording head 118 as shown in the state of FIG. 9. The absorbent 130 in the cap 126 prevents the nozzles from drying.

When a switch (not shown) for cleaning the nozzles of the recording head 118 is operated, a predetermined timing is reached during printing, or the ink cartridge 121 is to be replaced, the carriage 115 moves to the home position and the cap 126 covers the nozzles of the recording head 118 in the same manner as when the printing operation is suspended. When the suction pump 129 is driven in this state, highly viscous ink, dust, and the like collected in the vicinity of the nozzles are drawn in. The drawn in ink and the like are discharged to the waste liquid tank 135 through the first waste liquid duct 134, the waste liquid transfer passage 133, and the second waste liquid duct 137, and collected in the waste liquid tank 135 in a state absorbed in the absorbents 136.

In the present embodiment, the waste liquid tank 135 is arranged outside the frame 112 so that the capacity of the waste liquid tank 135 is not limited by the accommodation space in the frame 112. Thus, when the waste liquid tank 135 having a large capacity is used, the waste liquid drawn in from the nozzles of the recording head 118 by the suction pump 129 can be collected continuously in the waste liquid tank 135 without the waste liquid tank 135 becoming full within a short period of time.

When the waste liquid tank 135 becomes full with waste liquid, the waste liquid tank 135 must be replaced. In such a case, the nut 139 on the distal end of the second waste liquid duct 137 extending from the waste liquid tank 135, which is full, is removed from the threaded portion 138 of the discharge port 133*b* of the transfer device 131. The second waste liquid duct 137 is disconnected from the discharge port 133*b*. Then, the full waste liquid tank 135 is replaced with an empty waste liquid tank, and a nut on a distal end of a second waste liquid duct extending from the empty waste liquid tank is mated with the threaded portion 138 of the discharge port 133*b* of the transfer device 131 to connect the second waste liquid duct 137 to the discharge port 133*b*.

In this manner, in the present embodiment, the second waste liquid duct 137 extending from the waste liquid tank 135 via the transfer device 131 is connected to and disconnected from the first waste liquid duct 134 extending from the discharge side of the suction pump 129. This ensures easy connection and disconnection of the waste liquid ducts 134 and 137 and facilitates the replacement of the waste liquid tank 135. Further, the second waste liquid duct 137 is formed by a flexible tube and the waste liquid tank 135 can thus be arranged at any position behind the frame 112. In addition, the second waste liquid duct 137 can be easily connected to and disconnected from the discharge port 133*b* of the transfer device 131 when the waste liquid tank 135 is arranged at any position behind the frame 112. This facilitates the replacement of the waste liquid tank 135. Further, the valve mechanism 141, which is arranged in the connection between the second waste liquid duct 137 and the discharge port 133*b* of the transfer device 131, closes when the connection is disconnected. Thus, the waste liquid is prevented from leaking when the waste liquid tank 135 is replaced.

The third embodiment has the advantages described below.

The waste liquid tank 135 connected to the discharge port 133*b* of the transfer device 131 through the second waste liquid duct 137 is arranged outside the frame 112 of the printer 111. Thus, the capacity of the waste liquid tank 135 is not limited by the accommodation space in the frame 112. When the waste liquid tank 135 has a large-capacity, the printer 111 can perform large-volume printing.

When the waste liquid tank 135 becomes full with waste liquid, the waste liquid tank 135 can be replaced easily by removing the second waste liquid duct 137 from the pump side connection port 133*a* of the transfer device 131. Thus, the printer 111 can continuously perform large-volume printing.

The valve mechanism 141 for opening the distal end (upstream end) of the second waste liquid duct 137 when the second waste liquid duct 137 is connected to the transfer device 131 and closing the distal end of the second waste liquid duct 137 when the second waste liquid duct 137 is disconnected from the transfer device 131 is arranged in the discharge port 133*b*. Thus, the waste ink is prevented from leaking when the waste liquid tank 135 is replaced.

The transfer device 131 is arranged in the inkjet printer 111 so that a large amount of waste ink may be collected in the waste liquid tank 135 from the nozzles of the recording head 118. Thus, the printer 111 can perform large-volume printing. Further, the waste liquid tank 135 is arranged outside the frame 112 of the printer 111. Thus, the waste liquid tank 135 does not increase the size of the printer 111.

The attaching portions 120A and 120B for attaching the transfer device 131 on the frame 112 are defined by recesses, and the attaching portions 120A and 120B are located in the rear portion of the frame 112. Thus, the transfer device 131 is not exposed to the front of the printer 111. This keeps the appearance of the printer 111 in a satisfactory state.

A fourth embodiment of the present invention will be described focusing on differences from the third embodiment.

Figure 11:
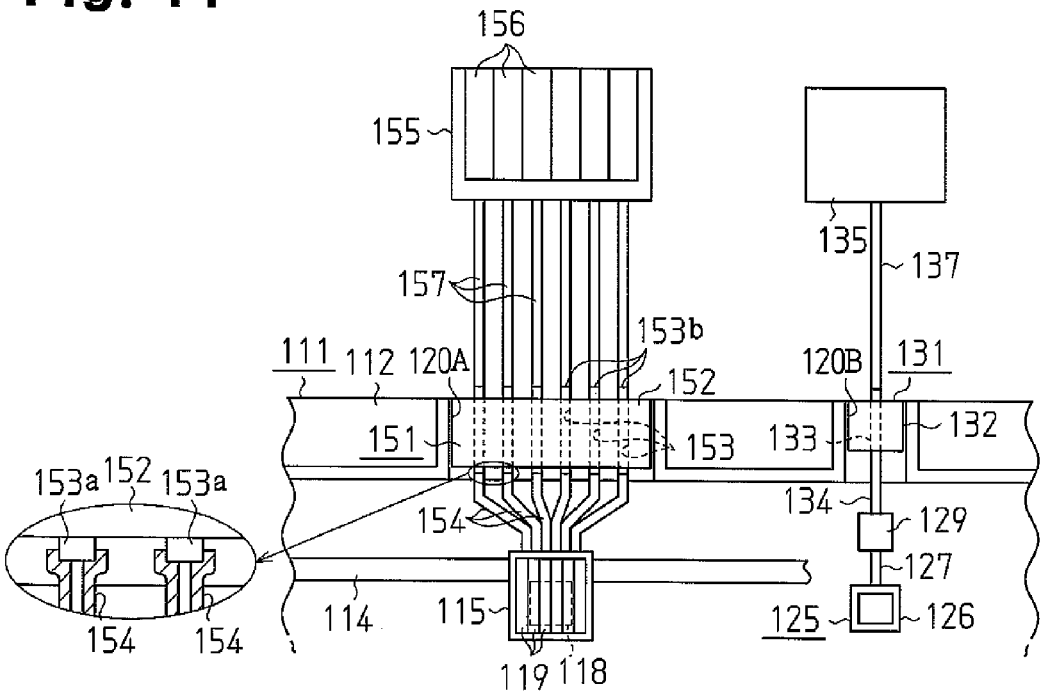
FIG. 11 is a partial plan view of a printer according to a fourth embodiment of the present invention.
Figure 12:
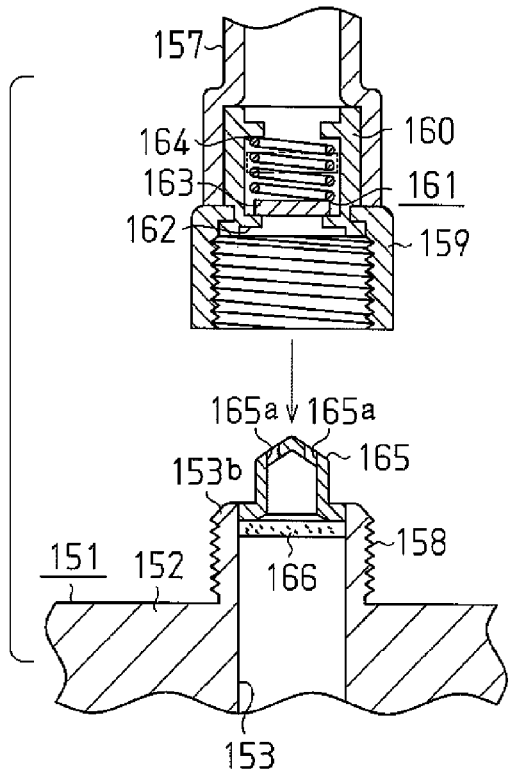
FIG. 12 is an enlarged exploded cross-sectional view of an essential part of the printer of FIG. 11 showing a valve mechanism of a transfer device.

In the fourth embodiment, as shown in FIGS. 11 and 12, a transfer device 151 for supply liquid is irremovably attached to a first attaching portion 120A formed in a rear portion of a frame 112 in lieu of the ink cartridges 121 of the first embodiment. The transfer device 151 has a rear surface exposed from the frame 112. The transfer device 151 has a rectangular block-shape main body 152 and a plurality of supply liquid transfer passages 153 formed in parallel at predetermined intervals in the main body 152. A cylindrical head side connection port 153*a* formed at the front end (downstream end) of each supply liquid transfer passage 153 project from the main body 152. A cylindrical tank side connection port 153*b* formed at the rear end (upstream end) of each supply liquid transfer passage 153 projects from the main body 152. A first supply duct 154, which is formed by a flexible tube, is connected and fixed to the head side connection port 153*a* of each supply liquid transfer passage 153. Each first supply duct 154 has a distal end (downstream end) connected to a corresponding valve unit 119 of a recording head 118.

A tank holder 155 is arranged behind the frame 112. The tank holder 155 detachably accommodates six large-capacity supply liquid tanks 156 containing different colors of ink. An upstream end of a second supply duct 157, which is formed by a flexible tube, is connected and fixed to each supply liquid tank 156, and a downstream end of each second supply duct 157 is detachably connected to the tank side connection port 153*b* of the corresponding supply liquid transfer passage 153 of the transfer device 151. In more detail, in the same manner as the connection between the transfer device 131 and the second waste liquid duct 137 in the third embodiment, a threaded portion 158, which is formed on an outer circumference of the tank side connection port 153*b*, and a nut 159, which is rotatably attached to a distal end of the second supply duct 157 with a support tube 160 arranged in between, are mated with each other screwed. This detachably connects each second supply duct 157 to the corresponding tank side connection port 153*b*.

A valve mechanism 161 is arranged in a connection between each second supply duct 157 and the corresponding tank side connection port 153*b*. The valve mechanism 161 includes a valve seat 162 arranged in the support tube 160 of the second supply duct 157, a valve member 163, a spring 164, and an open/close dog 165 having a through-hole 165*a* and formed in the tank side connection port 153*b* in the same manner as the valve mechanism 141 of the third embodiment. When the second supply duct 157 is connected to the tank side connection port 153*b*, the valve member 163 is pressed by the open/close dog 165 and spaced from the valve seat 162. As a result, the valve mechanism 161 opens. That is, the second supply duct 157 opens. When the second supply duct 157 is disconnected from the tank side connection port 153*b*, the urging force of the spring 164 causes the valve member 163 to contact the valve seat 162. This closes the valve mechanism 161. That is, the second supply duct 157 closes.

A filter 166 is arranged in the tank side connection port 153*b* of each supply liquid transfer passage 153. In a state in which each second supply duct 157 is connected to the tank side connection port 153*b* of the transfer device 151, the air pressure from a pressurizing pump (not shown) supplies ink from each supply liquid tank 156 to the corresponding valve unit 119 of the recording head 118 via the corresponding second supply duct 157, the transfer device 151, and the corresponding first supply duct 154. In this case, the filter 166 removes impurities or the like from the ink in the supply liquid transfer passage 153 of the transfer device 151.

The transfer device 131 for waste liquid and its related structure are the same as in the third embodiment.

In the fourth embodiment, the supply liquid tanks 156 are arranged outside the frame 112 so that the capacity of the supply liquid tanks 156 is not limited by the accommodation space in the frame 112. Thus, when the supply liquid tanks 156 having a large capacity are used, ink may be continuously supplied to the recording head 118 without requiring frequent replacement of the supply liquid tanks 156. In addition, the waste liquid tank 135 is arranged outside the frame 112 by way of the transfer device 131. This structure enables large-volume printing to be performed continuously. Further, each first supply duct 154 is formed by a flexible tube. Thus, each first supply duct 154 easily bends as the recording head 118 moves during the printing operation. Accordingly, the first supply duct 154 does not obstruct the movement of the recording head 118 or the supply of ink.

When all of the ink in the supply liquid tank 156 is consumed, the supply liquid tank 156 must be replaced. In such a case, the nut 159 on the distal end of the second supply duct 157 extending from the supply liquid tank 156 is removed from the threaded portion 158 of the tank side connection port 153*b* of the transfer device 151. Then, the second supply duct 157 is disconnected from the transfer device 151. Afterwards, a nut arranged on a distal end of a second supply duct extending from another supply liquid tank, which is filled with ink, is mated with the threaded portion 158 of the tank side connection port 153*b* of the transfer device 151. In this manner, the second supply duct 157 and the tank side connection port 153*b* are easily connected and disconnected. Thus, the empty supply liquid tank 156 can be easily replaced with another supply liquid tank, which is filled with ink. Further, each second supply duct 157 is formed by a flexible tube. Thus, the supply liquid tanks 156 can be arranged at any position behind the frame 112, the second supply ducts 157 can be easily connected to and disconnected from the tank side connection ports 153*b*, and the replacement of the supply liquid tanks 156 can be easily performed when the supply liquid tanks 156 are arranged at any position behind the frame 112. Further, the valve mechanism 161 is arranged in the connection between the distal end of the second supply duct 157 and the tank side connection port 153*b* of the transfer device 151, and the valve mechanism 161 is closed when the connection is disconnected. Thus, ink is prevented from leaking when the supply liquid tank 156 is replaced.

The fourth embodiment has the advantages described below in addition to the advantages of the third embodiment.

The waste liquid transfer device 131 transfers waste liquid to the waste liquid tank 135 from the suction pump 129, and the supply liquid transfer device 151 transfers ink from the supply liquid tanks 156 to the recording head 118. In this case, large-volume printing can be performed with a small number of components.

The second supply duct 157 extending from each supply liquid tank 156 is detachably connected to the corresponding tank side connection port 153*b* of the transfer device 151. Thus, the replacement of the supply liquid tank 156 is easily performed. This structure is preferable for continuously performing large-volume printing.

The valve mechanism 161, which opens the distal end of the second supply duct 157 when the second supply duct 157 is connected to the transfer device 131 and closes the distal end of the second supply duct 157 when the second supply duct 157 is disconnected from the transfer device 131, is arranged on the distal end (downstream end) of the second supply duct 157. Thus, ink is prevented from leaking when the supply liquid tank 156 is replaced.

The filter 166 arranged in each supply liquid transfer passage 153 of the transfer device 151 removes impurities and the like from the ink supplied to the recording head 118. This prevents such impurities and the like contained in the ink from causing abnormal functioning of the recording head 118 or causing ink ejection failures.

Each first supply duct 154 between the transfer device 151 and the recording head 118 is formed by a flexible tube, and is easily bent when the recording head 118 moves. Thus, the first supply duct 154 does not obstruct movement of the recording head 118.

Each second supply duct 157 between the transfer device 151 and the supply liquid tank 156 is formed by a flexible tube. Thus, the second supply duct 157 is easily connected to and disconnected from the transfer device 151, and the freedom of the arrangement of the supply liquid tank 156 is high.

The first attaching portion 120A of the transfer device 151 is arranged in the rear portion of the frame 112. Thus, the transfer device 151 is not exposed from the front of the printer 111. This keeps the appearance of the printer 111 in a satisfactory state.

A fifth embodiment of the present invention will now be described focusing on differences from the third and fourth embodiments.

Figure 13:
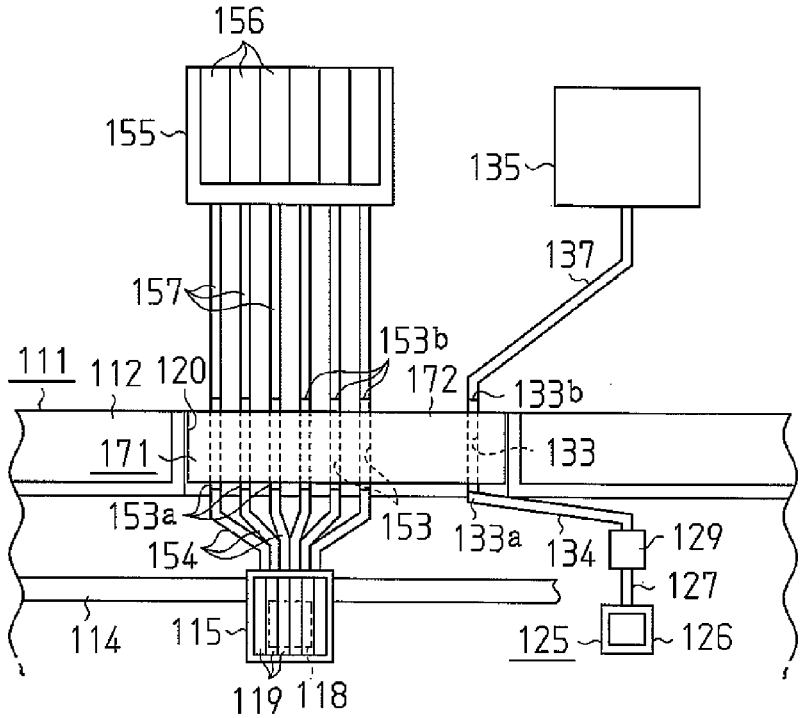
FIG. 13 is a partial plan view of a printer according to a fifth embodiment of the present invention.

In the fifth embodiment, as shown in FIG. 13, an attaching portion 120 is arranged in a rear portion of a frame 112 in lieu of the first attaching portion 120A and the second attaching portion 120B of the third and fourth embodiments. A transfer device 171 is irremovably attached to the attaching portion 120. The transfer device 171 has a main body (case) 172 including a waste liquid transfer passage 133 that is the same as in the third and fourth embodiments and a plurality of supply liquid transfer passages 153, which are arranged in parallel. More specifically, the transfer device 171 functions as a transfer device for waste liquid and a transfer device for supply liquid.

A pump side connection port 133*a* arranged in a front surface of the transfer device 171 is connected to a suction pump 129 (in more detail, a discharge side of the suction pump 129) by a first waste liquid duct 134. A plurality of head side connection ports 153*a* are arranged on the front surface of the transfer device 171 and connected to valve units 119 of a recording head 118 by first supply ducts 154. A discharge port 133*b* arranged in a rear surface of the transfer device 171 is connected to a waste liquid tank 135 by a second waste liquid duct 137. A plurality of tank side connection ports 153*b* are arranged in the rear surface of the transfer device 171 and connected to supply liquid tanks 156 by second supply ducts 157. The connection of the first waste liquid duct 134 and the second waste liquid duct 137 to the waste liquid transfer passage 133 and the connection of the first supply ducts 154 and the second supply ducts 157 to the supply liquid transfer passages 153 are the same as in the third and fourth embodiments.

The fifth embodiment has the advantages described below in addition to the advantages of the third and fourth embodiments.

The single transfer device 171 transfers waste liquid from the suction pump 129 to the waste liquid tank 135 and ink from the supply liquid tanks 156 to the recording head 118. This reduces the number of components. Further, the connection of the first waste liquid duct 134 and the second waste liquid duct 137 to the waste liquid transfer passage 133 and the connection of the first supply ducts 154 and the second supply ducts 157 to the supply liquid transfer passages 153 are concentrated at the same location. This improves the appearance of the printer 111.

A sixth embodiment of the present invention will now be described focusing on its differences from the third to fifth embodiments.

Figure 14:
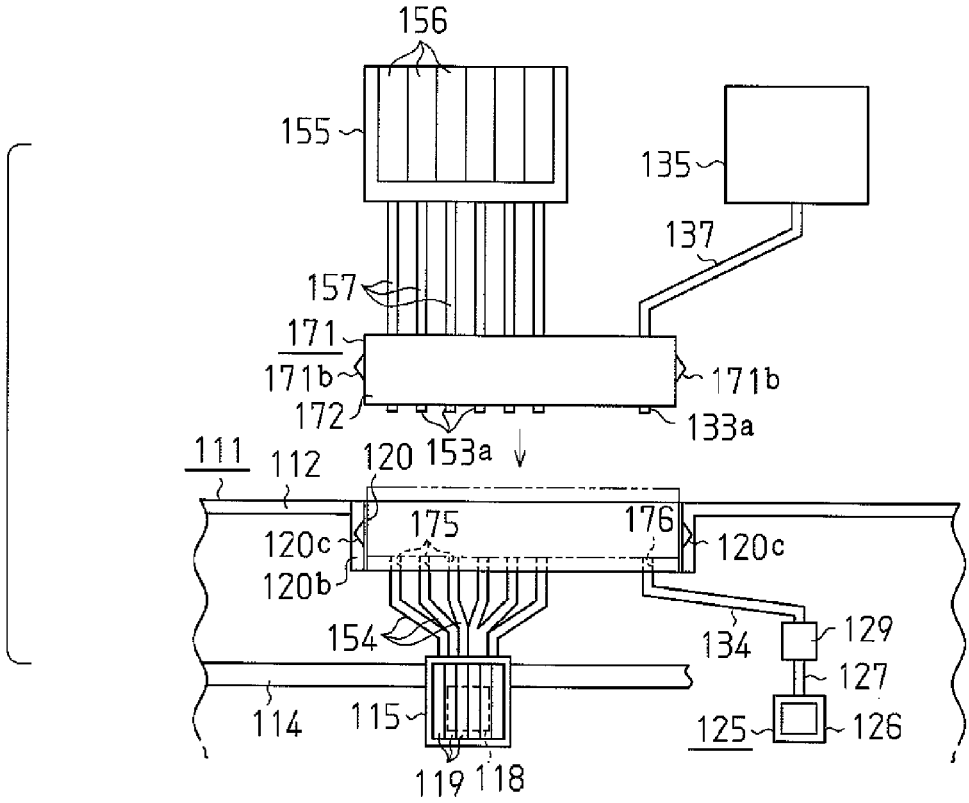
FIG. 14 is a partial plan view of a printer according to a sixth embodiment of the present invention.
Figure 15:
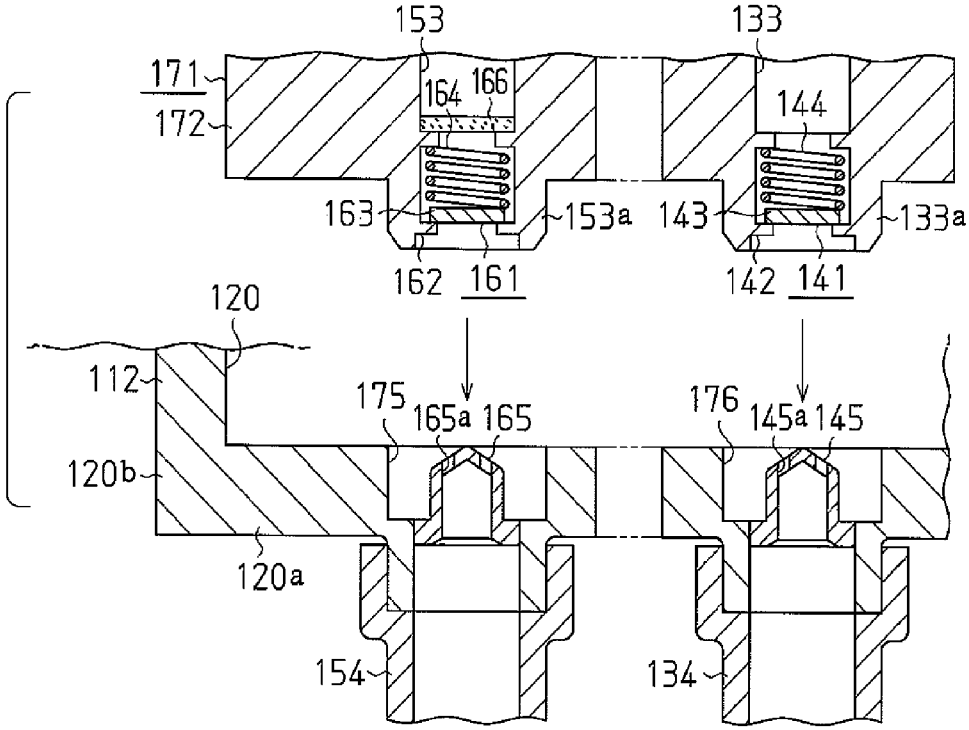
FIG. 15 is an enlarged exploded cross-sectional view of an essential part of the printer of FIG. 14 showing a valve mechanism of a transfer device.

In the sixth embodiment, as shown in FIGS. 14 and 15, an attaching portion 120 is defined by recess formed in a rear portion of a frame 112. A transfer device 171 having substantially the same structure as the transfer device 171 of the fifth embodiment is detachably attached to the attaching portion 120. The transfer device 171 has a rear surface exposed from the frame 112. The attaching portion 120 has a long side wall 120*a* including a plurality of first engagement holes 175, which are arranged in parallel at predetermined intervals, and a single second engagement hole 176. A first supply duct 154 extending from a valve unit 119 of a recording head 118 is connected to each first engagement hole 175, and a first waste liquid duct 134 extending from a discharge side of a suction pump 129 is connected to the second engagement hole 176. When the transfer device 171 is attached to the attaching portion 120 of the frame 112, a head side connection port 153*a* of the transfer device 171 is engaged with and connected to each first engagement hole 175 of the attaching portion 120, and a pump side connection port 133*a* of the transfer device 171 is engaged with and connected to the second engagement hole 176 of the attaching portion 120.

Two plate springs 171*b* are arranged on the outer surface of a main body 172 of the transfer device 171, and recesses 120*c* are arranged in the two short side walls 120*b* forming the attaching portion 120. When the transfer device 171 is attached to the attaching portion 120, each plate spring 171*b* is engaged with the corresponding recess 120*c*, so that the transfer device 171 is elastically supported in the attaching portion 120.

A valve mechanism 161 having substantially the same structure as the valve mechanism 161 of the fourth embodiment is arranged in the connection between each head side connection port 153*a* of the transfer device 171 and the corresponding first engagement hole 175 of the attaching portion 120. More specifically, the valve mechanism 161 includes a valve seat 162 arranged in the head side connection port 153*a*, a valve member 163, a spring 164, and an open/close dog 165 formed in the first engagement hole 175. When the head side connection port 153*a* is engaged with and connected to the first engagement hole 175, the valve member 163 is pressed by the open/close dog 165 and spaced from the valve seat 162. As a result, the valve mechanism 161 opens, and the head side connection port 153*a* opens. When the head side connection port 153*a* is disconnected from the first engagement hole 175, the urging force of the spring 164 causes the valve member 163 to contact the valve seat 162. As a result, the valve mechanism 161 closes, and the head side connection port 153*a* closes. Further, a filter 166 is arranged in the supply liquid transfer passage 153 near the valve mechanism 161.

A valve mechanism 141 having substantially the same structure as the valve mechanism 141 of the third embodiment is arranged in the connection between the pump side connection port 133*a* of the transfer device 171 and the second engagement hole 176 of the attaching portion 120. More specifically, the valve mechanism 141 includes a valve seat 142 arranged in the pump side connection port 133*a*, a valve member 143, a spring 144, and an open/close dog 145 projecting from the second engagement hole 176. When the pump side connection port 133*a* is engaged with and connected to the second engagement hole 176, the open/close dog 145 presses the valve member 143, and the valve member 143 is spaced from the valve seat 142. As a result, the valve mechanism 141 opens, and the pump side connection port 133*a* opens. When the pump side connection port 133*a* is disconnected from the second engagement hole 176, the urging force of the spring 144 causes the valve member 143 to contact the valve seat 142. As a result, the valve mechanism 141 closes, and the pump side connection port 133*a* closes.

The sixth embodiment has the advantages described below.

When the transfer device 171 is attached to the attaching portion 120 of the frame 112, each second supply duct 157 extending from the supply liquid tank 156 is connected to the corresponding first supply duct 154 extending from the recording head 118. Further, the second waste liquid duct 137 is connected to the first waste liquid duct 134 extending from the suction pump 129. When the transfer device 171 is removed from the attaching portion 120, each second supply duct 157 is disconnected from the corresponding first supply duct 154 and the second waste liquid duct 137 is disconnected from the first waste liquid duct 134. This facilitates replacement of the supply liquid tanks 156 and the waste liquid tank 135.

When the transfer device 171 is removed from the attaching portion 120, and the head side connection ports 153*a* and the pump side connection ports 133*a* are disconnected from the engagement holes 175 and 176. This closes the valve mechanisms 161 and 141. Thus, ink or the waste liquid is prevented from leaking when the supply liquid tanks 156 or the waste liquid tank 135 is replaced.

The third to sixth embodiments may be modified as described below.

Although the six valve units 119 are arranged in the recording head 118 and the six ink cartridges 121 are mounted on the frame 112 in the third embodiment, any number of valve units 119 and any number of ink cartridges 121 may be used. For example, a printer for single color printing may include a single valve unit 119 and a single ink cartridge 121, and a printer for printing the four colors of black, cyan, magenta, and yellow may include four valve units 119 and four ink cartridges 121. The six valve units 119 are arranged on the recording head 118 and the six supply liquid tanks 156 are mounted on the tank holder 155 in the fourth to sixth embodiments. However, any number of valve units 119 and any number of supply liquid tanks 156 may be used. For example, a printer for single color printing may include a single valve unit 119 and a single supply liquid tank 156. A printer for printing the four colors of black, cyan, magenta, and yellow may include four valve units 119 and four supply liquid tanks 156.

In the third and fourth embodiments, the transfer device 131 for a waste liquid is attached to the attaching portion 120 in the rear portion of the frame 112 in a manner that the transfer device 131 is not removable. However, the transfer device 131 may be detachably attached to the attaching portion 120 in the same manner as the transfer device 171 of the sixth embodiment.

In the fourth embodiment, the transfer device 151 for supply liquid is irremovably attached to the attaching portion 120 of the frame 112. However, the transfer device 151 may be detachably attached to the attaching portion 120 in the same manner as the transfer device 171 of the sixth embodiment.

In the third to sixth embodiments, portions of the ducts 134, 137, 154, and 157 connected to the transfer devices 131, 151, and 171 may be formed from flexible tubes, and the remaining portions may be formed from a material other than flexible tubes. For example, two distal portions of the ducts 134, 137, 154, and 157 may be formed from a rigid body made of metal such as stainless steel or hard synthetic resin, and intermediate portions between the two distal portions may be formed from flexible tubes.

In the third to sixth embodiments, the valve mechanisms 141 and 161 may be eliminated. In this case, a cap may be arranged to close the open end of the second waste liquid duct 137 or each second supply duct 157 when the second waste liquid duct 137 or the second supply duct 157 is disconnected from the transfer devices 131, 151, and 171.

A valve that is actuated by an external operation to open and close the transfer passages 133 and 153 of the transfer devices 131, 151, and 171 may be arranged in the transfer passages 133 and 153. In this case, the valve is used to close the transfer passages 133 and 153 so that ink is prevented from leaking from the connection ports 133*a*, 133*b*, 153*a*, and 153*b* or the like when the second waste liquid duct 137 or the second supply duct 157 is removed from the transfer devices 131, 151, and 171.

The inkjet printers 111 of the third to sixth embodiments may be replaced by liquid ejection apparatuses for ejecting liquid other than ink. For example, the inkjet printer 111 may be a liquid ejection apparatus for ejecting liquids such as an electrode material or a color material used to manufacture, for example, liquid crystal display, an EL (electroluminescence) display, or an FED (field emission display); a liquid ejection apparatus for ejecting living organisms for use in manufacturing a biochip; or a sample ejection apparatus such as a precision pipette.

A seventh embodiment of the present invention will now be described with reference to FIGS. 16 to 18.

Figure 16:
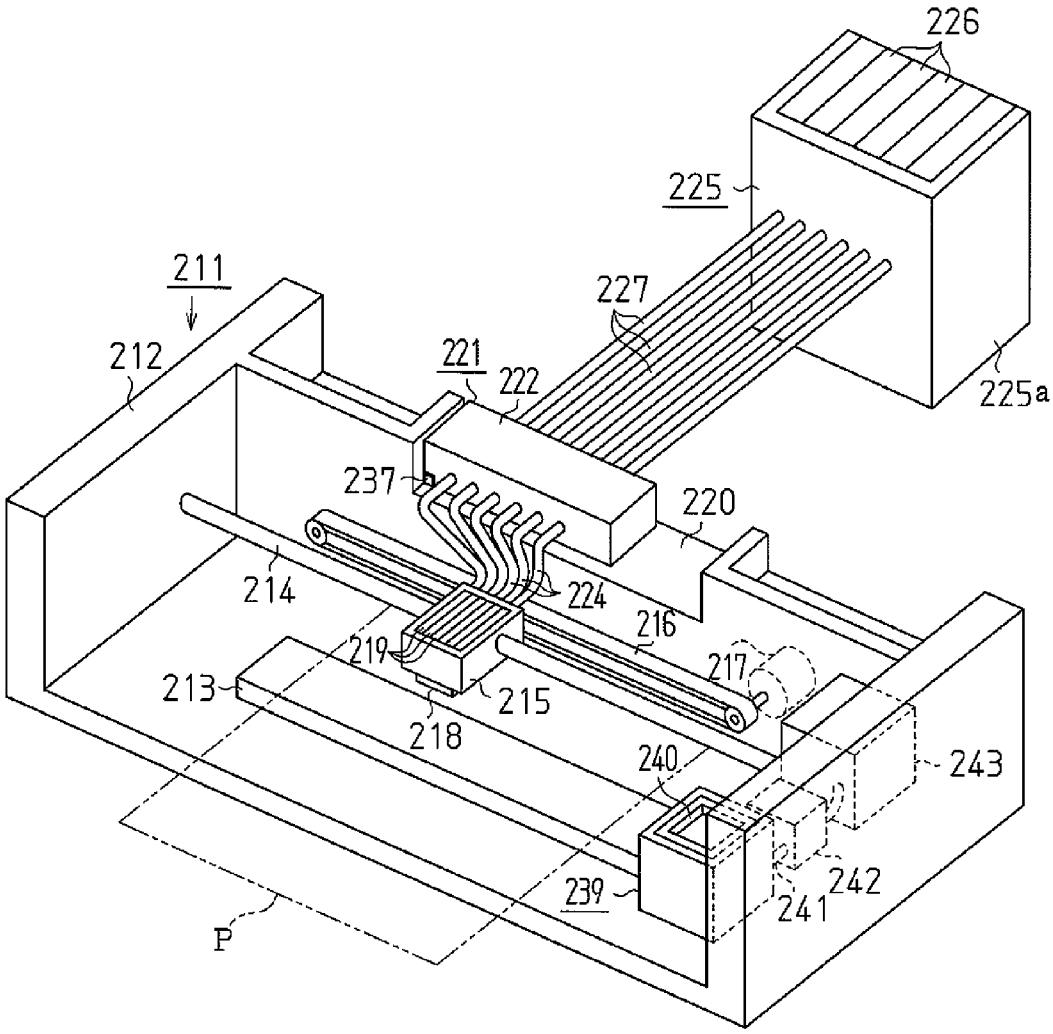
FIG. 16 is a perspective view of a printer according to a seventh embodiment of the present invention.

As shown in FIG. 16, in an inkjet printer 211 functioning as a liquid ejection apparatus of the seventh embodiment, a platen 213 is arranged on an apparatus frame 212, and a paper feeding mechanism (not shown) feeds a paper P functioning as a print medium onto the platen 213. A guide member 214 is arranged on the apparatus frame 212 extending parallel to the platen 213, and a carriage 215 is movably supported on the guide member 214. The carriage 215 is operably linked to a carriage motor 217 by a timing belt 216. The carriage 215 reciprocates within a predetermined range along the guide member 214 when the carriage motor 217 is driven. A cover (not shown) opens and closes an upper portion of the apparatus frame 212 and covers a region above a moving range of the carriage 215.

A recording head 218 functioning as an ejection head is mounted on a surface of the carriage 215 facing the platen 213. Six valve units 219 for supplying ink, which functions as liquid, to the recording head 218 are mounted on the carriage 215. The valve units 219 temporary contain predetermined amounts of six colors (six kinds) of ink used by the printer 211. The recording head 218 has a plurality of nozzles on its lower surface (not shown), and ink is ejected in dots from the nozzles onto the paper P, which functions as a target, to perform printing.

Figure 17:
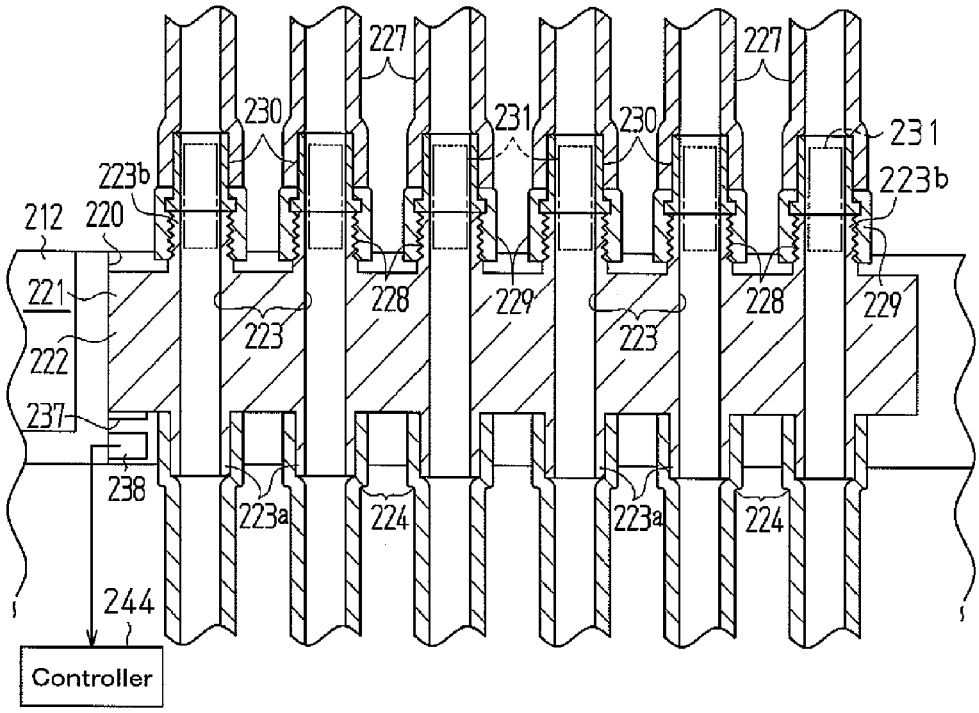
FIG. 17 is an enlarged cross-sectional view of an essential part of the printer of FIG. 16 showing a transfer device.

As shown in FIGS. 16 and 17, an attaching portion 220 is defined by a recess formed in a rear portion of the apparatus frame 212. A transfer device 221 is irremovably attached to the attaching portion 220. A rear surface of the transfer device 221 is exposed from the apparatus frame 212. A plurality of transfer passages 223 are arranged in parallel at predetermined intervals in a main body 222 of the transfer device 221. A cylindrical head side connection port 223*a* is formed at a front end (downstream end) of each transfer passage 223 to project from the main body 222. A cylindrical tank side connection port 223*b* is formed at a rear end (upstream end) of each transfer passage 223 to project from the main body 222. A first duct 224, which is formed by a flexible tube, is connected and fixed to the head side connection port 223*a* of each transfer passage 223. Each first duct 224 has a distal end (downstream end) connected to the corresponding valve unit 219 of the recording head 218. Each valve unit 219 does not have to contain a predetermined amount of ink. In such a case, the first duct 224 is connected to an ink receiving side of the nozzles of the recording head 218.

A tank 225 is arranged behind the apparatus frame 212. Six ink cartridges 226 having a large capacity are detachably accommodated within a tank case 225*a* of the tank 225. Each ink cartridge 226 contains different colors of ink. An upstream end of a second duct 227, which is formed by a flexible tube, is connected and fixed to each ink cartridge 226, and a downstream end of each second duct 227 is detachably connected to the tank side connection port 223*b* of the corresponding transfer passage 223 of the transfer device 221.

Figure 18:
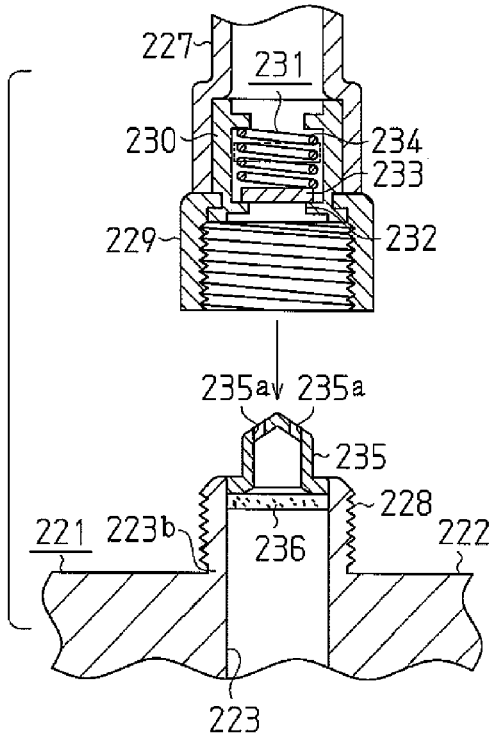
FIG. 18 is an enlarged exploded cross-sectional view of an essential part of the transfer device of FIG. 17 showing a valve mechanism.

In more detail, as shown in FIGS. 17 and 18, a threaded portion 228 is formed on an outer circumference of each tank side connection port 223*b* of the transfer device 221, and a nut 229 is rotatably arranged on a distal end of each second duct 227 with a support tube 230 arranged in between. The nut 229 is mated with the threaded portion 228 so that each second duct 227 is detachably connected to the corresponding tank side connection port 223*b*.

A valve mechanism 231 is arranged in a connection between each second duct 227 and the corresponding tank side connection port 223*b*. The valve mechanism 231 includes a valve seat 232 arranged in the support tube 230 of the second duct 227, a valve member 233 arranged to face the valve seat 232 in a manner that the valve member 233 can contact or be spaced from the valve seat 232, a spring 234 for urging the valve member 233 toward the valve seat 232, and an open/close dog 235 formed in the tank side connection port 223*b* to move the valve member 233. The open/close dog 235 has through-holes 235*a* that permit the passage of ink. When the second duct 227 is connected to the tank side connection port 223*b*, the valve member 233 is pressed by the open/close dog 235 and spaced from the valve seat 232. As a result, the valve mechanism 231 opens. That is, the second duct 227 opens. When the second duct 227 is disconnected from the tank side connection port 223*b*, the urging force of the spring 234 causes the valve member 233 to contact the valve seat 232 so that the valve mechanism 231 closes. That is, the second duct 227 closes.

In a state in which each second duct 227 is connected to the tank side connection port 223*b* of the transfer device 221, the air pressure from a pressurizing pump (not shown) supplies ink from each ink cartridge 226 to the corresponding valve unit 219 of the recording head 218 through the corresponding second duct 227, the transfer device 221, and the corresponding first duct 224.

A filter 236 is arranged in the tank side connection port 223*b* of each transfer passage 223. The filter 236 removes impurities, clots, or the like from the ink.

As shown in FIGS. 16 and 17, a storage unit 237 is arranged on the main body 222 of the transfer device 221. The storage unit 237 stores attribute data including the identification number of the transfer device 221, the type of the transfer device 221, and the usable kinds of ink. A read device 238 functioning as a reading means is arranged on the attaching portion 220 in the apparatus frame 212 of the printer 211 in correspondence with the storage unit 237. When the transfer device 221 is attached to and fixed to the attaching portion 220, the read device 238 reads the attribute data of the transfer device 221 from the storage unit 237, and stores the data in a memory of a controller 244 arranged on the apparatus frame 212. The controller 244 forms the reading means together with the read device 238. The controller 244 performs various processes including determination as to whether the attached transfer device 221 is appropriate based on the attribute data read from the read device 238.

As shown in FIG. 16, a nozzle protection unit 239 for protecting the nozzle function of the recording head 218 is arranged at a position corresponding to a home position of the recording head 218 in a region outside a print range at one side of the apparatus frame 212. The nozzle protection unit 239 includes a square box-shaped cap 240 having a top opening, an ink tube 241 extending from the bottom of the cap 240, a tube pump 242 arranged on the ink tube 241, and a waste ink tank 243 connected to one end of the ink tube 241.

When printing is not performed and the carriage 215 is moved to the home position, the cap 240 covers the nozzles of the recording head 218 to prevent the nozzles from drying. Ink absorbents (not shown) are arranged in the waste ink tank 243. When the tube pump 242 is driven in a state in which the nozzles of the recording head 218 are covered by the cap 240, highly viscous ink, dust, and the like in the vicinity of the nozzles of the recording head 218 are discharged to the waste ink tank 243 through the ink tube 241 and stored in the waste ink tank 243 in a state absorbed in the absorbents.

The operation of the printer 211 having the transfer device 221 will now be described.

In the states shown in FIGS. 16 and 17, the distal end of the second duct 227 extending from the ink cartridge 226 on the tank case 225*a*, which is arranged behind the apparatus frame 212, is connected to the tank side connection port 223*b* of the transfer device 221. When the printer 211 performs printing in this state, the carriage 215 moves along the guide member 214, and ink stored in each ink cartridge 226 is supplied to the corresponding valve unit 219 through the corresponding second duct 227, the transfer device 221, and the corresponding first duct 224 so that ink is ejected from the nozzles of the recording head 218 onto the paper P.

In the present embodiment, the ink tank 225 having the ink cartridges 226 is arranged outside the apparatus frame 212. Thus, the capacity of the ink cartridges 226 is not limited by the accommodation space in the apparatus frame 212. When the ink cartridges 226 have a large capacity, ink may be continuously supplied to the recording head 218 without having to frequently replace the ink cartridges 226, and large-volume printing may be continuously performed. Further, each first duct 224 is formed by a flexible tube. Thus, the first duct 224 easily bends as the recording head 218 moves when performing printing. Thus, the first duct 224 does not obstruct the movement of the recording head 218 or the supply of ink.

When all of the ink in the ink cartridge 226 is consumed, the ink cartridge 226 must be replaced. In such a case, the nut 229 on the distal end of the second duct 227 extending from the empty ink cartridge 226 is removed from the threaded portion 228 of the tank side connection port 223*b* of the transfer device 221, and the second duct 227 is disconnected from the tank side connection port 223*b*. Afterwards, the empty ink cartridge 226 is removed from the tank case 225*a*, and a new ink cartridge 226, which is filled with ink, is mounted on the tank case 225*a*. A nut 229 on a distal end of a second duct 227 of the new ink cartridge 226 is mated with the threaded portion 228 of the tank side connection port 223*b* of the transfer device 221 to connect the second duct 227 to the tank side connection portion 223*b*.

In this way, in the present embodiment, the second ducts 227 extending from the ink cartridges 226 via the transfer device 221 are connected to and disconnected from the first ducts 224 extending from the recording head 218. This ensures easy connection and disconnection of the ducts 224 and 227 and facilitates the replacement of the ink cartridges 226. Further, each second duct 227 is formed by a flexible tube. Thus, the second duct 227 can be easily connected to and disconnected from the corresponding tank side connection port 223*b* of the transfer device 221 wherever the ink cartridges 226 are arranged behind the apparatus frame 212. This facilitates the replacement of the ink cartridges 226. Further, the valve mechanism 231 is arranged in a connection between the distal end of each second duct 227 and the corresponding tank side connection port 223*b* of the transfer device 221. The valve mechanism 231 is closed when the connection is disconnected. Thus, the ink is prevented from leaking when the ink cartridge 226 is replaced.

The seventh embodiment has the advantages described below.

The transfer device 221 arranged on the apparatus frame 212 of the printer 211 has the transfer passages 223. The head side connection port 223*a* is arranged on one end of each transfer passage 223. The tank side connection port 223*b* is arranged on the other end of each transfer passage 223. The recording head 218 is connected to the head side connection port 223*a*, and each cartridge 226 of the tank 225 is connected to the corresponding tank side connection port 223*b*. This ensures connection of the tank 225 and the recording head 218 by way of the transfer device 221 without the need for processing the ink cartridges 226 or form joints for enabling such connection. Further, ink is smoothly supplied to the recording head 218 through the transfer passage 223 from the tank 225 when the tank 225 and the recording head 218 are connected to each other. This enables the tank 225 to have a large capacity irrespective of the size or the shape of the printer 211. Further, the tank 225 is not directly connected to the recording head 218. Thus, the closing of a cover (not shown) of the printer 211 is not obstructed by any ducts extending between the tank 225 and the recording head 218. As a result, the cover effectively prevents dust from entering the printer 211, and the aesthetic appeal of the printer 211 is not adversely affected. Further, as long as the transfer device 221 is arranged in the attaching portion 220, excessive force is not applied to the first ducts 224 or the like between the transfer device 221 and the recording head 218 when the recording head 218 reciprocates. Further, without the need to mount an attachment on the carriage 215 of the printer 211, the weight on the carriage 215 does not significantly change. This eliminates adverse effects on the movement of the carriage 215 that would be caused by such an attachment. Accordingly, printing is performed with high-quality.

The transfer device 221 has the plurality of transfer passages 223, which may supply different kinds of ink separately to the plurality of nozzles of the recording head 218. Thus, the transfer device 221 is optimal for use in the inkjet printer 211.

The filter 236 is arranged in each transfer passage 223, and the filter 236 removes impurities and the like from ink in the supply passage to the recording head 218. This prevents the recording head 218 from being clogged.

The transfer device 221 has the storage unit 237, which may be used to preset and manage the attributes of the transfer device 221, such as the identification number and the type of the transfer device 221. Thus, when the transfer device 221 is used as the ink passage of the printer 211, the usable types of ink or the like may be effectively managed.

The structure including the nut 229 that is detachably connected to each second duct 227 extending from the tank 225 is arranged on the corresponding tank side connection port 223*b* of the transfer device 221. Thus, the second duct 227 is easily connected to and disconnected from the tank side connection port 223*b*, and the second duct 227 remains connected to the tank side connection port 223*b* in a satisfactory manner.

The valve mechanism 231, which closes when the second duct 227 is disconnected, is arranged in the tank side connection port 223*b*. Thus, the ink is prevented from leaking from the tank side connection port 223*b* when the second duct 227 is disconnected to replace the tank 225.

The first ducts 224 and second ducts 227 are formed by flexible tubes. Thus, the first ducts 224 and the second ducts 227 are easily bent as the recording head 218 moves. Thus, the first duct 224 and the second duct 227 do not obstruct the movement of the recording head 218 or the supply of liquid.

The printer 211 includes the read device 238 and the controller 244, which form the reading means for reading the storage content of the storage unit 237 arranged in the transfer device 221. Thus, the read device 238 and the controller 244 may be used to identify the attributes of the transfer device 221 so that the attaching status of the transfer device 221 may be managed.

The attaching portion 220 on which the transfer device 221 is attached is formed by a recess, and the transfer device 221 is attached to the attaching portion 220. Thus, the transfer device 221 does not project greatly out of the apparatus frame 212, and the aesthetic appeal of the printer 211 is maintained in a satisfactory state.

The attaching portion 220 is arranged in the rear portion of the apparatus frame 212 of the printer 211. Thus, the transfer device 221 is not exposed from the front of the printer 211, and the aesthetic appeal of the printer 211 is maintained in a satisfactory state.

Each second duct 227, which is formed by a flexible tube, may be connected to and disconnected from the corresponding tank side connection port 223*b*. Thus, the flexible tube may be bent and flexed so that the tank 225 can be easily connected to and disconnected from the tank side connection ports 223*b* to facilitate the replacement of the tank 225. Further, the tank 225 may be arranged at any position outside the printer 221.

An eighth embodiment of the present invention will now be described focusing on its differences from the seventh embodiment.

Figure 19:
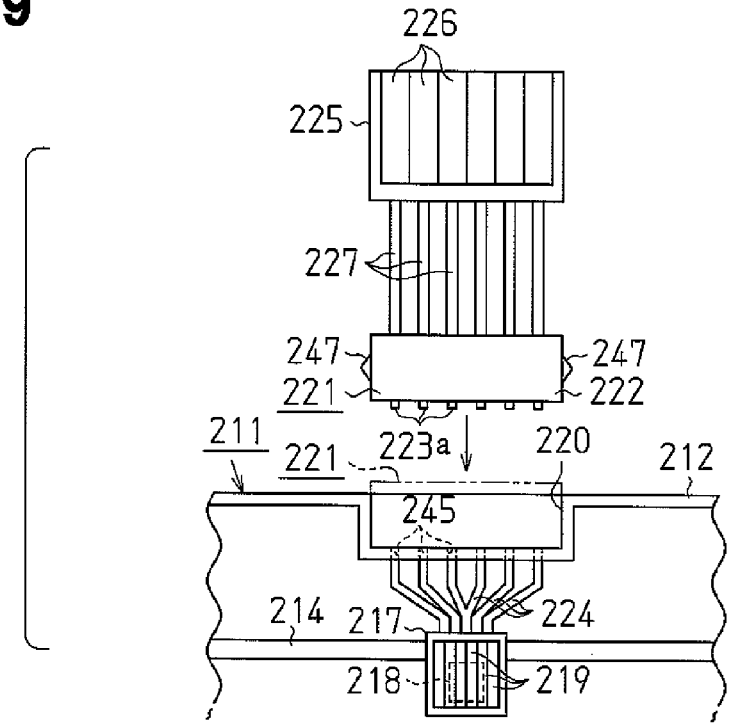
FIG. 19 is a partial plan view of a printer according to an eighth embodiment of the present invention.
Figure 20:
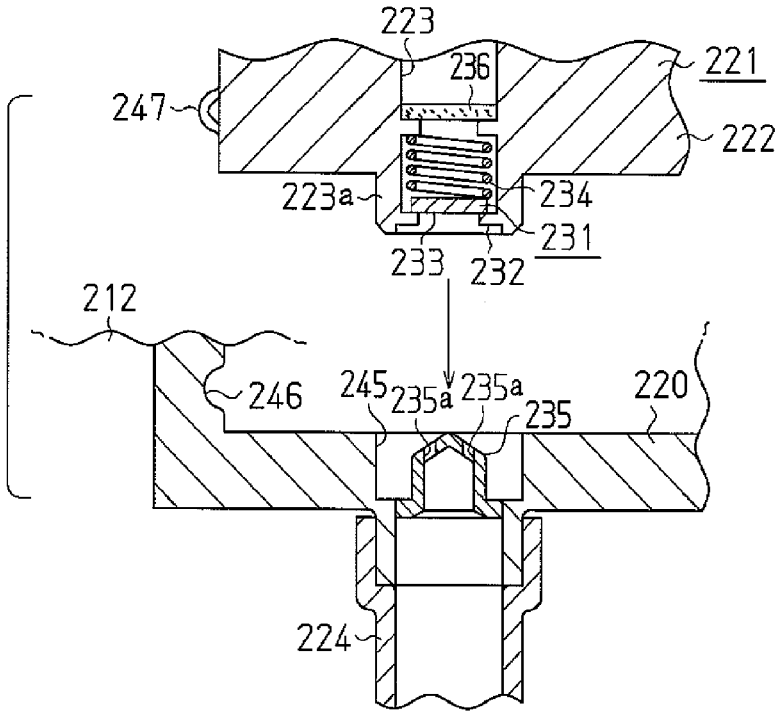
FIG. 20 is an enlarged exploded cross-sectional view of an essential part of the printer of FIG. 19 showing a valve mechanism of a transfer device.

In the eighth embodiment, as shown in FIGS. 19 and 20, a transfer device 221 is detachably attached to an attaching portion 220 defined by a recess formed in a rear portion of an apparatus frame 212. The transfer device 221 has a rear surface exposed from the apparatus frame 212. A spring 247 is arranged on the transfer device 221, and a recess 246 is formed in the attaching portion 220 for elastically supporting the transfer device 221 in the attaching portion 220. The spring 247 and the recess 246 are engaged with each other.

A plurality of engagement holes 245, each including an open/close dog 235, are formed at predetermined intervals in the attaching portion 220, and a first duct 224 extending from a valve unit 219 of a recording head 218 is connected to each engagement hole 245. When the transfer device 221 is attached to the attaching portion 220 of the apparatus frame 212, each head side connection port 223*a* of the transfer device 221 is engaged with and connected to the corresponding engagement hole 245 of the attaching portion 220. More specifically, in the eighth embodiment, the transfer device 221 is attached to the attaching portion 220 so that the head side connection ports 223*a* are engaged with the engagement holes 245 and connected to the first ducts 224. A sealing means, such as a seal ring (not shown), is arranged between an outer circumferential surface of the head side connection port 223*a* and an inner circumferential surface of the engagement hole 245 to prevent leakage of ink.

A valve mechanism 231 having substantially the same structure as the valve mechanism 231 of the seventh embodiment is arranged in the connection between each head side connection port 223*a* of the transfer device 221 and the corresponding engagement hole 245 of the attaching portion 220. More specifically, the valve mechanism 231 includes a valve seat 232 formed in the head side connection port 223*a*, a valve member 233 arranged to face the valve seat 232 in a manner that the valve member 233 can contact or be spaced from the valve seat 232, a spring 234 for urging the valve member 233 toward the valve seat 232, and an open/close dog 235 arranged in the engagement hole 245 for moving the valve member 233. When the head side connection port 223*a* is engaged with and connected to the engagement hole 245, the valve member 233 is pressed by the open/close dog 235 and spaced from the valve seat 232. This opens the valve mechanism 231. When the head side connection port 223*a* is disconnected from the engagement hole 245, the urging force of the spring 234 causes the valve member 233 to contact the valve seat 232. This closes the valve mechanism 231.

In this manner, in the eighth embodiment, each second duct 227 extending from the ink cartridge 226 is easily connected to and disconnected from the corresponding first duct 224 extending from the recording head 218 by attaching and detaching the transfer device 221 to and from the attaching portion 220 of the apparatus frame 212. As a result, the ink cartridge 226 is easily replaced. Further, when the head side connection ports 223*a* are disconnected from the engagement holes 245 by removing the transfer device 221 from the attaching portion 220, each valve mechanism 231 is closed. Thus, ink is prevented from leaking when the ink cartridges 226 are replaced.

The eighth embodiment has the advantages described below in addition to the advantages of the seventh embodiment.

The transfer device 221 can be attached to and detached from the attaching portion 220. Each head side connection port 223*a* of the transfer device 221 can be connected to and disconnected from the corresponding first duct 224. Thus, detachment and attachment of the transfer device 221 on the attaching portion 220 facilitates replacement of the tank 225.

The transfer device 221 can be attached to and detached from the apparatus frame 212 of the printer 211. When the transfer device 221 is attached to the apparatus frame 212, each head side connection port 223*a* of the transfer device 221 is connected to the corresponding first duct 224. With this structure, the recording head 218 and the tank 225 is easily disconnected by removing the transfer device 221 from the apparatus frame 212. This facilitates the replacement of the tank 225.

The transfer device 221 is partially exposed when the transfer device 221 is attached to the attaching portion 220. Thus, the transfer device 221 is easily attached or detached by holding the exposed portion of the transfer device 221.

The valve mechanism 231, which closes when the first duct 224 is disconnected from the transfer device 221, is arranged in the connection between each first duct 224 and the transfer device 221. Thus, ink is prevented from leaking when the transfer device 221 is removed from the apparatus frame 212.

The seventh and eighth embodiments may be modified in the following forms.

Although the six valve units 219 are arranged on the recording head 218 and the six ink cartridges 226 are mounted on the tank 225 in the seventh and eighth embodiments, any number of valve units 219 and any number of ink cartridges 226 may be used.

The location of the attaching portion 220 of the transfer device 221 may be changed from the rear portion of the apparatus frame 212 to another position such as a side portion or a lower portion of the apparatus frame 212.

The two end portions of each first duct 224 and each second duct 227 may be made of metal, such as stainless steel, and the intermediate portion between the two distal portions may be formed by a flexible tube. In such a case, the first duct 224 and the second duct 227 are further firmly y connected to the transfer device 221, and ink is prevented from being degraded by gas transmitted through the flexible tubes.

A valve mechanism that is operable by an external device may be arranged in the outlet of each ink cartridge 226. In this case, the outlet of the ink cartridge 226 may be closed when the tank 225 is replaced to prevent the ink from leaking.

Instead of using a pressurizing pump, the ink cartridges 226 may be arranged at positions higher than the recording head 218, and the height difference may be used to supply ink from the ink cartridges 226 to the recording head 218.

The inkjet printers 211 of the seventh and eighth embodiments may be replaced by liquid ejection apparatuses for ejecting liquids other than ink. For example, the inkjet printer 211 may be a liquid ejection apparatus for ejecting liquids such as an electrode material or a color material used to manufacture, for example, liquid crystal display, an EL display, or an FED (field emission display); a liquid ejection apparatus for ejecting living organisms for use in manufacturing a biochip; or a sample ejection apparatus as a precision pipette.

What is claimed is:

1. A waste liquid collection apparatus for use in a state arranged outside a plurality of liquid ejection mechanisms, each constructed to independently eject liquid onto different media each including an ejection head with a nozzle that ejects liquid from the nozzle and a suction pump with a discharge side that draws in liquid from the nozzle of the ejection head, the waste liquid collection apparatus comprising:

a waste liquid tank including a plurality of connection ports, each connectable to the discharge side of the suction pump included in a corresponding one of the liquid ejection mechanisms.

2. The waste liquid collection apparatus according to claim 1, wherein each connection port connected to the discharge side of the corresponding suction pump is disconnectable from the discharge side of the corresponding suction pump.

3. The waste liquid collection apparatus according to claim 2, further comprising a closing portion arranged in each connection port for opening the connection port when the connection port is connected to the discharge side of the corresponding suction pump and closing the connection port when the connection port is disconnected from the discharge side of the corresponding suction pump.

4. The waste liquid collection apparatus according to claim 3, wherein the closing portion is formed by a valve mechanism that opens and closes when the connection port is connected to and disconnected from the discharge side of the suction pump.

5. The waste liquid collection apparatus according to claim 1, wherein each connection port is arranged on an end of a duct that is at least partially formed by a flexible tube.

6. The waste liquid collection apparatus according to claim 1, further comprising a supply liquid tank containing supply liquid to be supplied to each ejection head.

7. The waste liquid collection apparatus according to claim 6, wherein the supply liquid tank is connected to each ejection head via a further duct that is at least partially formed by a flexible tube.

8. The waste liquid collection apparatus according to claim 7, further comprising a closing portion arranged in each further duct for opening the further duct when the supply liquid tank and the corresponding ejection head are connected and closing the further duct when the supply liquid tank and the corresponding ejection head are disconnected.

9. The waste liquid collection apparatus according to claim 6, wherein the waste liquid tank and the supply liquid tank are integrated.

10. The waste liquid collection apparatus according to claim 9, wherein the waste liquid tank and the supply liquid tank are supported in a manner enabling attachment to and detachment from a single case.

11. A system comprising:

a plurality of liquid ejection mechanisms each constructed to independently eject liquid onto different media, each including an ejection head with a nozzle that ejects liquid from the nozzle and a suction pump with a discharge side that draws in liquid from the nozzle of the ejection head when the ejection head is not ejecting liquid; and a waste liquid tank including a plurality of connection ports each connectable to the discharge side of the suction pump included in a corresponding one of the liquid ejection mechanisms.

12. A transfer device for use with a liquid ejection mechanism including an ejection head with a nozzle that ejects liquid from the nozzle and a suction pump with a discharge side that draws in liquid from the nozzle of the ejection head, the transfer device comprising a waste liquid transfer passage having an upstream end and a downstream end, wherein the upstream end of the waste liquid transfer passage includes a pump side connection port connected to the discharge side of the suction pump, and the downstream end of the waste liquid transfer passage includes a discharge port for discharging the liquid drawn in by the suction pump, wherein the discharge port detachably connects a duct extending from a waste liquid tank for collecting the liquid drawn in by the suction pump, wherein the duct is provided with a valve seat, a valve member arranged to face the valve seat so that the valve member can be in contact with or spaced from the valve seat, and a spring for urging the valve member toward the valve seat, wherein the discharge port of the transfer device is provided with a dog, wherein when the duct is connected to the discharge port of the transfer device, the valve member is pressed by the dog and spaced from the valve seat, so that the duct is in an open state, and wherein when the duct is disconnected from the discharge port of the transfer device, the urging force of the spring causes the valve member to contact the valve seat, so that the duct is in a closed state.

13. The transfer device according to claim 12, further comprising a supply liquid transfer passage having an upstream end and a downstream end, wherein the upstream end of the supply liquid transfer passage includes a tank side connection port that is connected to a supply liquid tank containing liquid, and the downstream end of the supply liquid transfer passage includes a head side connection port connected to the ejection head for ejecting liquid supplied from the supply liquid tank.

14. The transfer device according to claim 13, further comprising a duct extending from the supply liquid tank and connected to the tank side connection port in a disconnectable manner.

15. The transfer device according to claim 14, further comprising a valve mechanism, arranged in the tank side connection port, for opening the duct when the duct is connected to the tank side connection port and closing the duct when the duct is disconnected from the tank side connection port.

16. The transfer device according to claim 13, further comprising a filter arranged in the supply liquid transfer passage.

17. The transfer device according to claim 13, further comprising a case including the waste liquid transfer passage and the supply liquid transfer passage.

18. A liquid ejection apparatus comprising:

an ejection head with a nozzle that ejects liquid from the nozzle; and a suction pump with a discharge side that draws in liquid from the nozzle of the ejection head; and a transfer device including a waste liquid transfer passage having an upstream end and a downstream end, the upstream end of the waste liquid transfer passage including a pump side connection port connected by a duct to the discharge side of the suction pump, and the downstream end of the waste liquid transfer passage including a discharge port for discharging the liquid drawn in by the suction pump; and a frame, wherein the transfer device is attachable to and detachable from the frame, and wherein the frame has a recessed attaching portion for attaching the transfer device to the frame, the transfer device being partially exposed when attached to the attaching portion.

19. The liquid ejection apparatus according to claim 18, further comprising:

a supply liquid transfer passage having an upstream end and a downstream end, the upstream end of the supply liquid transfer passage including a tank side connection port that is connected to a supply liquid tank containing liquid, and the downstream end of the supply liquid transfer passage including a head side connection port connected by a duct to the ejection head for ejecting liquid supplied from the supply liquid tank.

20. The liquid ejection apparatus according to claim 19, wherein the duct between the head side connection port of the transfer device and the ejection head is at least partially formed by a flexible tube.

21. The liquid ejection apparatus according to claim 18, wherein the ejection head is a recording head for ejecting ink dots onto a print medium while reciprocating within a predetermined range.

22. The liquid ejection apparatus according to claim 18 wherein the attaching portion is located at a rear portion of the frame.

23. The liquid ejection apparatus according to claim 18 further comprising a valve mechanism arranged in the tank side connection port of the transfer device for opening the duct extending from the supply liquid tank when the duct is connected to the tank side connection port and closing the duct when the duct is disconnected from the tank side connection port.

24. A transfer device to be attached to a liquid ejection mechanism including an ejection head with a nozzle that ejects liquid from the nozzle, the transfer device comprising:

a main body;

a transfer passage provided in the main body, the transfer passage having an upstream end and a downstream end, wherein the upstream end of the transfer passage includes a tank side connection port connected to a duct extending from a tank containing liquid, and the downstream end of the transfer passage includes a head side connection port connected to a duct extending from the ejection head for ejecting liquid supplied from the tank; and a storage unit for storing data on an attribute of the transfer device, wherein the storage unit is arranged on the main body, wherein when the transfer device is attached to the liquid ejection mechanism, the data stored in the storage unit is read by a reading portion of the liquid ejection mechanism.

25. The transfer device according to claim 24, wherein the transfer passage is one of a plurality of transfer passages.

26. The transfer device according to claim 24, further comprising a filter arranged in the transfer passage.

27. The transfer device according to claim 24, wherein the tank side connection port is connectable to and disconnectable from the duct extending from the tank.

28. The transfer device according to claim 24, further comprising a valve mechanism, arranged in the tank side connection port, for opening the duct extending from the tank when the duct is connected to the tank side connection port and closing the duct when the duct is disconnected from the tank side connection port.

29. The transfer device according to claim 24, wherein the head side connection port is connectable to and disconnectable from the duct extending from the ejection head.

30. A liquid ejection apparatus comprising:

an ejection head for ejecting liquid onto a target; an apparatus frame including an attaching portion; and a transfer device including a transfer passage having an upstream end and a downstream end, the upstream end of the transfer passage including a tank side connection port connected to a duct extending from a tank containing liquid, and the downstream end of the transfer passage including a head side connection port connected to a duct extending from the ejection head for ejecting liquid supplied from the tank, wherein the transfer device is attached to the attaching portion.

wherein the attaching portion is recessed, and the transfer device is at least partially exposed when attached to the attaching portion.

31. The liquid ejection apparatus according to claim 30, wherein the duct connecting the ejection head to the head side connection port is at least partially formed by a flexible tube.

32. The liquid ejection apparatus according to claim 30, further comprising a reading portion for reading a content of a storage unit arranged on the transfer device.

33. The liquid ejection apparatus according to claim 30, wherein the transfer device is attachable to and detachable from the attaching portion, and the duct is connected to the head side connection port of the transfer device when the transfer device is attached to the attaching portion.

34. The liquid ejection apparatus according to claim 33, wherein the attaching portion is arranged at a rear portion of the apparatus frame.

35. The liquid ejection apparatus according to claim 30, further comprising a tank connected to the tank side connection port of the transfer device by a duct.

36. The liquid ejection apparatus according to claim 35, wherein the duct connecting the tank to the tank side connection port is at least partially formed by a flexible tube, and the duct is connectable to and disconnectable from the tank side connection port.

37. A liquid ejection apparatus comprising:

an ejection head for ejecting liquid onto a target;

an apparatus frame including an attaching portion;

a transfer device including a transfer passage having an upstream end and a downstream end, the upstream end of the transfer passage including a tank side connection port connected to a duct extending from a tank containing liquid, and the downstream end of the transfer passage including a head side connection port connected to a duct extending from the ejection head for ejecting liquid supplied from the tank, wherein the transfer device is attached to the attaching portion; and a valve mechanism, arranged in a connection between the duct and the transfer device, for opening the head side connection port when the duct is connected to the transfer device and closing the head side connection port when the duct is disconnected from the transfer device, wherein the transfer device is attachable to and detachable from the attaching portion, and the duct is connected to the head side connection port of the transfer device when the transfer device is attached to the attaching portion.

* * * * *